US010363734B2

(12) United States Patent
Merka et al.

(10) Patent No.: US 10,363,734 B2
(45) Date of Patent: Jul. 30, 2019

(54) METHOD FOR MAKING LITHOGRAPHIC PRINTING PLATES

(71) Applicant: Eastman Kodak Company, Rochester, NY (US)

(72) Inventors: Oliver Merka, Gottingen (DE); Jan-Phillip Kemmling, Bilshausen (DE); Oliver Richard Blum, Bovenden (DE); Benedikt Uhl, Ulm (DE); Philipp Viehmann, Gottingen (DE)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 16/122,000

(22) Filed: Sep. 5, 2018

(65) Prior Publication Data

US 2019/0016110 A1 Jan. 17, 2019

Related U.S. Application Data

(63) Continuation-in-part of application No. 15/447,651, filed on Mar. 2, 2017.

(51) Int. Cl.
*B41C 1/10* (2006.01)
*B41M 1/06* (2006.01)

(52) U.S. Cl.
CPC ..... *B41C 1/1033* (2013.01); *B41C 1/1008* (2013.01); *B41M 1/06* (2013.01); *B41C 2210/04* (2013.01)

(58) Field of Classification Search
None
See application file for complete search history.

(56) References Cited

U.S. PATENT DOCUMENTS 4,566,952 A 1/1986 Sprintschnik et al.
8,783,179 B2 7/2014 Kurokawa et al.
(Continued)

FOREIGN PATENT DOCUMENTS

EP 0316240 A1 5/1989
EP 1642745 A2 4/2006
(Continued)

*Primary Examiner* — Joshua D Zimmerman
(74) *Attorney, Agent, or Firm* — J. Lanny Tucker

(57) ABSTRACT

On-press developable, negative-working lithographic printing plate precursors are used to provide lithographic printing plates. Such precursors are prepared with a substrate and one or more negative-working, infrared radiation-sensitive imagable layers. The substrate is prepared by two separate anodizing processes to provide an inner aluminum oxide layer having an average dry thickness ($T_i$) of 650-3,000 nm and inner micropores having an average inner micropore diameter ($D_i$) of <15 nm. A formed outer aluminum oxide layer comprises outer micropores having an average outer micropore diameter ($D_o$) of 15-30 nm; an average dry thickness ($T_o$) of 130-650 nm; and a micropore density ($C_o$) of 500-3,000 micropores/$\mu m^2$. The ratio of $D_o$ to $D_i$ is greater than 1.1:1, and $D_o$ in nanometers and the outer aluminum oxide layer micropore density ($C_o$) in micropores/$\mu m^2$, are further defined by the outer aluminum oxide layer porosity ($P_o$) as:

$$0.3 \leq P_o \leq 0.8$$

wherein $P_o$ is $3.14(C_o)(D_o^2)/4{,}000{,}000$.

12 Claims, 1 Drawing Sheet

(56) References Cited

U.S. PATENT DOCUMENTS

| | | | |
|---|---|---|---|
| 2008/0003411 | A1 | 1/2008 | Hunter et al. |
| 2011/0265673 | A1 | 11/2011 | Tagawa et al. |
| 2012/0192742 | A1 | 8/2012 | Kurokawa et al. |
| 2013/0052582 | A1 | 2/2013 | Hayashi |
| 2014/0047993 | A1 | 2/2014 | Hauck et al. |
| 2014/0326151 | A1 | 11/2014 | Namba et al. |
| 2015/0135979 | A1 | 5/2015 | Tagawa et al. |

FOREIGN PATENT DOCUMENTS

| | | | |
|---|---|---|---|
| EP | 2353882 | A1 | 8/2011 |
| EP | 2520439 | A1 | 11/2012 |

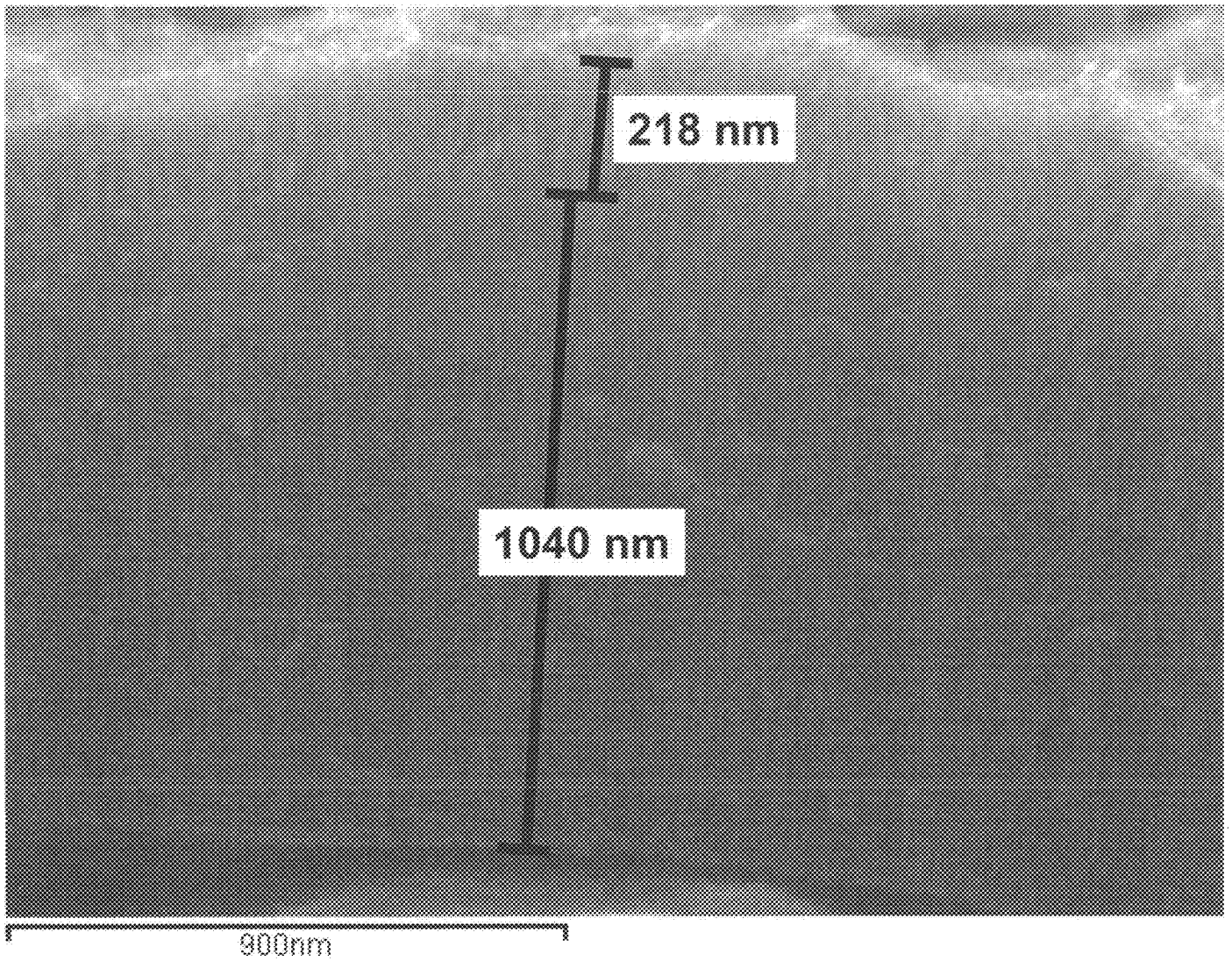
218 nm
1040 nm
900nm

METHOD FOR MAKING LITHOGRAPHIC PRINTING PLATES

RELATED APPLICATIONS

This is a Continuation-in-part of copending and commonly assigned U.S. Ser. No. 15/447,651, filed Mar. 2, 2017 by Merka, Kemmling, Blum, and Uhl.

FIELD OF THE INVENTION

This invention relates to the novel lithographic printing plate precursors and to their preparation and use for imaging and on-press development to provide lithographic printing plates. These precursors comprise an inventive aluminum-containing substrate that has been prepared using two separate anodizing processes to provide different aluminum oxide layers with different structural properties.

BACKGROUND OF THE INVENTION

In lithographic printing, lithographic ink receptive regions, known as image areas, are generated on a hydrophilic planar surface of a substrate. When the printing plate surface is moistened with water and a lithographic printing ink is applied, hydrophilic regions retain the water and repel the lithographic printing ink, and the lithographic ink receptive image regions accept the lithographic printing ink and repel the water. The lithographic printing ink is transferred from the lithographic printing plate to the surface of a material upon which the image is to be reproduced, perhaps with the use of a blanket roller.

Imagable elements or lithographic printing plate precursors used to prepare lithographic printing plates typically comprise one or more radiation-sensitive imagable layers disposed on the hydrophilic surface of the substrate. Following imaging, either the exposed (imaged) regions or the non-exposed (non-imaged) regions of the one or more radiation-sensitive layers can be removed, revealing the hydrophilic surface of the substrate. If the exposed regions are removable, the lithographic printing plate precursor is considered positive-working. Conversely, if the non-exposed regions are removable, the lithographic printing plate precursor is considered negative-working.

Direct digital thermal imaging of lithographic printing plate precursors has become increasingly important in the printing industry in the last 30 years because of their stability to ambient light. Such precursors have been designed to be sensitive to imaging near-infrared radiation of at least 750 nm.

Negative-working lithographic printing plate precursors useful to prepare lithographic printing plates typically comprise a negative-working radiation-sensitive imagable layer disposed over the hydrophilic surface of a substrate. Radiation-sensitive photopolymerizable compositions used in negative-working lithographic printing plate precursors typically comprise free-radically polymerizable components, one or more radiation absorbers, an initiator composition, and optionally one or more polymeric binders that are different from the other noted components.

In recent years, there has been an emphasis in the industry for simplification of the lithographic printing plate making process, including an omission of the pre-development heating step (preheat) and carrying out development on-press (DOP) using a lithographic printing ink, fountain solution, or both, to remove unwanted (non-exposed) imagable layer materials on the lithographic printing plate precursors. Such negative-working lithographic printing plate precursors must be designed by balancing many features within the element structure in order to achieve optimal press life, on-press developability, and scratch resistance. It has not been an easy task to achieve high quality in all of these properties because what chemical composition or structural features may provide optimal level in one or two properties may cause a loss in another property.

Independently of the type of lithographic printing plate precursor, lithography has generally been carried out using a metal-containing substrate comprising aluminum or an aluminum-alloy of various metal compositions, for example containing up to 10 weight % of one or more of other metals known in the art for this purpose. The raw stock aluminum-containing material can be cleaned in a "pre-etch" process using a base or surfactant solution to remove oil, grease, and other contaminants on the planar surface of the raw stock aluminum-containing material. The cleaned planar surface is then generally roughed by electrochemical or mechanical graining, followed by a "post-etch" treatment to remove any contaminants ("smut") formed during the graining process. Further industrial details of the preparation of useful substrates for lithographic printing plate precursors are found in U.S. Patent Application Publication 2014/0047993 A1 (Hauck et al.).

After further rinsing, the planar surface of the aluminum-containing substrate is then anodized one or more times to provide an outermost hydrophilic aluminum oxide layer for abrasion resistance and other properties of the resulting lithographic printing plate precursor once one or more imagable layers have been formed thereon.

One or more anodizing processes are used in some known methods of making precursor substrates, for example, as described in U.S. Pat. No. 4,566,952 (Sprintschnik et al.) and U.S. Pat. No. 8,783,179 (Kurokawa et al.), U.S. Patent Application Publications 2011/0265673 (Tagawa et al.), 2012/0192742 (Kurokawa et al.), 2014/0326151 (Namba et al.), and 2015/0135979 (Tagawa et al.), and EP 2,353,882A1 (Tagawa et al.).

In these known methods of making precursor substrates, sulfuric acid, phosphoric acid, or both sulfuric acid and phosphoric acid have been used as electrolytes in combination with various process parameters in order to produce one or more anodic (aluminum oxide) layers of specific structures and thus achieve specific properties in the resulting precursors. However, it has been found that lithographic printing plate precursors prepared according to these known methods are still unsatisfactory in one or more precursor properties such as scratch resistance, on-press developability, and press life.

Thus, there remains a need to balance the manufacturing conditions, especially during anodization, for negative-working lithographic printing plate precursors so that improved scratch resistance is achieved without sacrificing press life and on-press developability.

SUMMARY OF THE INVENTION

The present invention provides a method for providing a lithographic printing plate, comprising the steps in the order of:

A) providing an on-press developable, negative-working lithographic printing plate precursor comprising a substrate and a negative-working, infrared radiation-sensitive imagable layer;

B) imagewise exposing the on-press developable, negative-working lithographic printing plate precursor to infrared radiation to form an imaged lithographic printing plate precursor having infrared radiation exposed and infrared radiation non-exposed regions in an imaged surface of the negative-working, infrared radiation-sensitive imagable layer;

C) without any prior wet processing, mounting the imaged lithographic printing plate precursor onto a lithographic printing press comprising:

a plate cylinder for holding the imaged lithographic printing plate precursor, an inking system capable of supplying a lithographic printing ink to the imaged surface, a dampening system capable of supplying a fountain solution to the imaged surface, a blanket cylinder capable of transferring the lithographic printing ink from the imaged lithographic printing plate precursor, an impression cylinder capable of pressing one or more printing papers onto the blanket cylinder, and thus transferring the lithographic printing ink from the blanket cylinder onto the one or more printing papers, and a printing paper feeding system for supplying the one or more printing papers to the impression cylinder;

D) engaging the dampening system;

E) causing not more than 20 revolutions of the plate cylinder;

F) engaging the inking system;

G) causing not more than 20 revolutions of the plate cylinder;

H) feeding printing papers for at least 1 and up to and including 30 revolutions of the plate cylinder until the imaged lithographic printing plate precursor is fully developed to become a functioning lithographic printing plate having ink-accepting image regions substantially corresponding to the infrared radiation exposed regions and non-ink-accepting hydrophilic non-image regions substantially corresponding to the infrared radiation non-exposed regions; and I) operating the lithographic printing press beyond the revolutions of the plate cylinder required for completing step E) to produce a desired number of lithographically printed papers, wherein the lithographic printing plate precursor comprises:

(i) a substrate having a planar surface, and (ii) a negative-working, infrared radiation-sensitive imagable layer disposed over the planar surface of the substrate, wherein the (i) substrate comprises:

an aluminum-containing plate having a grained and etched planar surface;

an inner aluminum oxide layer disposed on the grained and etched planar surface, the inner aluminum oxide layer having an average dry thickness ($T_i$) of at least 650 nm and up to and including 3,000 nm; and comprising a multiplicity of inner micropores having an average inner micropore diameter ($D_i$) of less than 15 nm;

an outer aluminum oxide layer disposed on the inner aluminum oxide layer, the outer aluminum oxide layer: comprising a multiplicity of outer micropores having an average outer micropore diameter ($D_o$) of at least 15 nm and up to and including 30 nm; having an average dry thickness ($T_o$) of at least 130 nm and up to and including 650 nm; and having a micropore density ($C_o$) of at least 500 micropores/$\mu m^2$ and up to and including 3,000 micropores/$\mu m^2$, wherein the ratio of the average outer micropore diameter ($D_o$) to the average inner micropore diameter ($D_i$) is greater than 1.1:1, and the average outer micropore diameter ($D_o$) in nanometers and the micropore density ($C_o$) in micropores/$\mu m^2$, are further constrained by the porosity ($P_o$) of the outer aluminum oxide layer according to the following equation:

$$0.3 \leq P_o \leq 0.8$$

wherein $P_o$ is $3.14(C_o)(D_o^2)/4{,}000{,}000$; and optionally, a hydrophilic coating comprising one or more hydrophilic polymers, which hydrophilic coating is disposed on the outer aluminum oxide layer at a dry coverage of at least 0.0002 g/$m^2$ and up to and including 0.1 g/$m^2$.

In addition, the present invention provides a method for preparing a lithographic printing plate precursor, comprising, in order:

providing an aluminum-containing plate having an electrochemically or mechanically grained and etched planar surface;

subjecting the aluminum-containing plate to a first anodizing process to form an outer aluminum oxide layer on the electrochemically or mechanically grained and etched planar surface, the outer aluminum oxide layer: comprising a multiplicity of outer micropores having an average outer micropore diameter ($D_o$) of at least 15 nm and up to and including 30 nm; having an average dry thickness ($T_o$) of at least 130 nm and up to and including 650 nm; and having a micropore density of at least 500 pores/$\mu m^2$ and up to and including 3,000 micropores/$\mu m^2$; wherein the average outer micropore diameter ($D_o$) in nanometers and the micropore density ($C_o$) in micropores/$\mu m^2$, are further constrained by the porosity ($P_o$) of the outer aluminum oxide layer according to the following equation:

$$0.3 \leq P_o \leq 0.8$$

wherein $P_o$ is $3.14(C_o)(D_o^2)/4{,}000{,}000$;

rinsing the outer aluminum oxide layer;

subjecting the aluminum-containing plate to a second anodizing process to form an inner aluminum oxide layer underneath the outer aluminum oxide layer, the inner aluminum oxide layer having: an average dry thickness ($T_i$) of at least 650 nm and up to and including 3,000 nm; and comprising a multiplicity of inner micropores having an average inner micropore diameter ($D_i$) of less than 15 nm, wherein the ratio of the average outer micropore diameter ($D_o$) to the average inner micropore diameter ($D_i$) is greater than 1.1:1;

rinsing the outer aluminum oxide layer and the inner aluminum oxide layer;

providing a hydrophilic coating comprising one or more hydrophilic polymers on the outer aluminum oxide layer at a dry coverage of at least 0.0002 g/$m^2$ and up to and including 0.1 g/$m^2$, and forming a radiation-sensitive imagable layer on the outer aluminum oxide layer with the hydrophilic coating;

The combination of features defined for the substrate used in the lithographic printing plate precursors provides improved scratch resistance while maintaining desired on-press developability and high press life after infrared radiation imaging. These advantages are achieved by using a combination of two unique anodizing processes that are carried out in such a manner as to achieve the recited features of both the inner and outer aluminum oxide layers that form the inventive substrates in the precursors. As the data provided herein demonstrate, when either or both aluminum oxide layers are outside the required limits, one or more of scratch resistance, on-press developability, and press life are reduced or impaired in some manner.

BRIEF DESCRIPTION OF THE DRAWING

FIG. 1 is a black-and-white, cross-sectional scanning electron micrograph (SEM) image of an inventive substrate prepared according to the present invention and having an outer aluminum oxide layer having an average dry thickness ($T_o$) of 218 nm and an inner aluminum oxide layer having an average dry thickness ($T_i$) of 1040 nm.

DETAILED DESCRIPTION OF THE INVENTION

The following discussion is directed to various embodiments of the present invention and while some embodiments can be desirable for specific uses, the disclosed embodiments should not be interpreted or otherwise considered to limit the scope of the present invention, as claimed below. In addition, one skilled in the art will understand that the following disclosure has broader application than is explicitly described and the discussion of any embodiment.

Definitions

As used herein to define various components of the radiation-sensitive imagable layer formulations (and resulting dried layers), processing solutions, anodizing solutions, hydrophilic coating formulations (and resulting dried layers), and other materials used in the practice of this invention, unless otherwise indicated, the singular forms "a," "an," and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term should be interpreted as having a standard dictionary meaning.

The use of numerical values in the various ranges specified herein, unless otherwise expressly indicated otherwise, are considered to be approximations as though the minimum and maximum values within the stated ranges were both preceded by the word "about." In this manner, slight variations above and below the stated ranges may be useful to achieve substantially the same results as the values within the ranges. In addition, the disclosure of these ranges is intended as a continuous range including every value between the minimum and maximum values as well as the end points of the ranges.

Unless the context indicates otherwise, when used herein, the terms "negative-working radiation-sensitive lithographic printing plate precursor," "precursor," "radiation-sensitive precursor," and "lithographic printing plate precursor" are meant to be equivalent references of certain embodiments of the present invention.

The term "support" is used herein to refer to an aluminum-containing or other metal-containing material (sheet, web, strip, sheet, foil, or other form) that can be then treated to prepare a "substrate" as described in more detail below.

Average outer micropore diameter ($D_o$) in nanometers (nm) can be determined from a top view SEM image at a magnification of at least 50,000× taken from the substrate surface before the application of the hydrophilic coating and the radiation-sensitive imagable layer or layers. It is also possible to determine the outer micropore diameter ($D_o$) of a lithographic printing plate precursor by striping the organic layers with appropriate solvents and optionally removing about 20 nm to 80 nm thick outer portion of the outer aluminum oxide layer using an appropriate technique such as argon ion beam sputtering before taking the top view of the SEM image. The average can be determined by reviewing over 200 outer micropores.

Average inner micropore diameter ($D_i$) can be determined from a cross-sectional view SEM image at a magnification of at least 50,000×. The cross-section can be generated by bending the lithographic printing plate precursor or its substrate after the imagable layers and the hydrophilic coating have been removed. During bending, cracks are formed in the aluminum oxide layer and new surfaces are formed usually at the weakest position, which is usually located at the thinnest walls between adjacent inner micropores. Therefore, the new surfaces of cracks provide cross-sectional views of many micropores. For the present invention, it is not necessary to determine the exact average inner micropore diameter ($D_i$) as long as at least 90% of revealed micropore cross-sections has a width below 15 nm.

Average dry thickness ($T_o$) of the outer anodizing layer and average dry thickness ($T_i$) of the inner anodizing layer, in nanometers (nm), each can be determined from the cross-section SEM images of at least 50,000× magnification. The cross-sections of the aluminum oxide layer can be revealed through the cracks formed by bending a lithographic printing plate precursor or its substrate. The cross-sections of the aluminum oxide layer can also be revealed by cutting a slot through the aluminum oxide layer by a focused ion beam (FIB), a technique well known in the art.

The outer anodizing layer micropore density ($C_o$), in micropores/$\mu m^2$, can be determined from the top view SEM pictures of at least 50,000× magnification by counting the number of micropores in a predetermined area of a square having an area of at least 500 nm by 500 nm.

The porosity ($P_o$) of the outer aluminum oxide layer can be constrained by either of the following equations:

$$0.3 \le P_o \le 0.8 \text{ or}$$

$$0.3 \le P_o \le 0.6,$$

wherein $P_o$ is $3.14(C_o)(D_o^2)/4{,}000{,}000$

As used herein, the term "infrared region" refers to radiation having a wavelength of at least 750 nm and higher. In most instances, the term "infrared" is used to refer to the "near-infrared" region of the electromagnetic spectrum that is defined herein to be at least 750 nm and up to and including 1400 nm. Similarly, infrared radiation absorbers provide sensitivity in the infrared region.

For clarification of definitions for any terms relating to polymers, reference should be made to "Glossary of Basic Terms in Polymer Science" as published by the International Union of Pure and Applied Chemistry ("IUPAC"), *Pure Appl. Chem.* 68, 2287-2311 (1996). However, any definitions explicitly set forth herein should be regarded as controlling.

As used herein, the term "ethylenically unsaturated polymerizable monomer" refers to a compound comprising one or more ethylenically unsaturated (—C═C—) bonds that are polymerizable using free radical or acid-catalyzed polymerization reactions and conditions. It is not meant to refer to chemical compounds that have only unsaturated —C═C— bonds that are not polymerizable under these conditions.

Unless otherwise indicated, the term "weight %" refers to the amount of a component or material based on the total solids of a composition, formulation, or dry layer. Unless otherwise indicated, the percentages can be the same for either a dry layer or the total solids of the formulation or composition used to form that dry layer.

As used herein, the term "layer" or "coating" can consist of one disposed or applied layer or a combination of several sequentially disposed or applied layers. If a layer is considered radiation-sensitive and negative-working, it is both sensitive to suitable infrared radiation and negative-working in the formation of lithographic printing plates.

Uses

The lithographic printing plate precursors described herein are useful for forming lithographic printing plates for lithographic printing using a lithographic printing ink and fountain solution. These precursors are prepared with the structure and components described as follows. In addition, the present invention is useful for preparing such lithographic printing plates by imagewise exposing and processing the exposed precursor on-press using a lithographic printing ink, a fountain solution, or a combination of a lithographic printing ink and a fountain solution as described below. The lithographic printing plate precursors described herein are designed to be negative-working using the appropriate materials and manufacturing procedures described below.

The present invention is also useful for manufacturing of such lithographic printing plate precursors that can then be sold to customers for use in imaging and printing.

Inventive Substrate

The inventive substrates useful in the precursors used in the present invention are designed with critical features and properties in order to achieve the advantages described above.

A general description relating to the production of substrates useful for lithographic printing plate precursors can be found in US Patent Application Publication 2014/0047993 A1 (noted above) the disclosure of which is herein incorporated by reference for details not explicitly provided herein.

In general, the lithographic printing plate substrate can be derived from an aluminum or other metal material, such as an aluminum alloy containing up to 10% by weight of one or more elements including but not limited to, manganese, silicon, iron, titanium, copper, magnesium, chromium, zinc, bismuth, nickel, and zirconium. The aluminum- or aluminum alloy-containing support (or "plate" or "raw stock") can have any form from which it can be further processed, including sheets, continuous webs and coiled strips as long as it has at least one planar surface that can be treated as described below to form a hydrophilic planar surface in the inventive substrates. It is also possible to use polymeric films or papers onto which pure aluminum- or aluminum alloy-containing layers are deposited or laminated.

The resulting substrate should be thick enough to mechanically withstand the conditions in a modern printing press, but thin enough to be installed on (or wrapped around) a printing cylinder of such a machine. Thus, the substrates should also have appropriate tensile strength, elasticity, crystallinity, and conductivity needed for lithographic printing. These properties can be achieved by standard methods such as heat treatments or cold and hot rolling typical for the fabrication of continuous lithographic support strips, webs, or coils. Dry thicknesses of the resulting inventive substrates are generally at least 100 μm and up to and including 600 μm.

The described aluminum-containing supports can be treated using typical lithographic printing plate precursor manufacturing processes, including pre-etch, water rinse, roughening, water rinse, post-etch, and final water rinse, in combination with the first and second anodizing process described in more detail below.

The raw stock aluminum-containing support is typically subjected to a pre-etching step to remove oil, grease, and metallic or other contaminants at or near the planar surface. As is known in the art, this pre-etching step can be carried using a sodium hydroxide or other aqueous alkaline solutions or even certain organic solvents at known concentrations, times, and temperatures. A separate or additional degreasing step can be carried out using an aqueous surfactant solution if desired. A skilled worker would be able to carry out routine experimentation to find the optimal pre-etching conditions (for example, optimal solution concentration, dwell time, and temperature).

Typically, after the pre-etching step, the etched support is "roughened" in a suitable manner such as by using a known electrochemical or mechanical roughening (or graining) process. In electrochemical graining treatments, the etched support can be processed with alternating electric current in a solution of 5 to 20 g/liter hydrochloric acid. It is also possible to use solutions of nitric acid (for example, at up to 2.5 weight %) or sulfuric acid or mixtures for this purpose. Such electrochemical graining solutions can also contain additives such as corrosion inhibitors and stabilizers, including but not limited to metal nitrates, metal chlorides, monoamines, diamines, aldehydes, phosphoric acid, chromic acid, boric acid, lactic acid, acetic acid, and oxalic acid. For example, electrochemical graining can be carried out using the processes described in U.S. Patent Application Publication 2008/0003411 (Hunter et al.), the disclosure of which is incorporated herein by reference. A skilled worker would be able to determine by routine experimentation the optimal conditions for either electrochemical or mechanical graining as such processes are well known in the art. Mechanical graining processes can be carried out for example with suitable brushes alone or in combination with a slurry of abrasive materials such as silica particles or alumina particles. Alternatively, a combination of mechanical and electrochemical graining processes can be used.

During roughening or graining, smut can be formed on the planar surface of the support and this smut can be removed in a post-etching step using a treatment with a highly acidic or highly alkaline solution, for example, to remove 0.01-5.0 $g/m^2$ of the support surface. For example, post-etching can be carried out using a solution of sodium hydroxide, trisodium phosphate, or sulfuric acid. The amount of post-etching can be controlled by setting dwell time, concentration, and temperature of the etching solution. A suitable amount of post-etching also depends on the amount of roughening and the amount of smut formed in that step. The post-etching treatment must be sufficient to remove the smut, but it should not destroy too much of the surface structures formed in the roughening step. Thus, there are many combinations of the parameters that a skilled artisan can consider during routine experimentation to find the optimum post-etching conditions.

The foregoing steps result in an electrochemically or mechanically grained (roughened) and etched planar surface in the aluminum-containing support.

The next steps include a first anodizing process and a second anodizing process, both of which are essential, to form outer and inner aluminum oxide layers, respectively. The method of the present invention does not require additional anodizing processes (that is, third or more anodizing processes) as are sometimes described in the prior art, so that in most embodiments, the first and second anodizing processes described herein are the only anodizing processes. If a third anodizing process is carried out, it can be achieved with relatively high voltage but low charge density in order to enhance the barrier layer between the inner micropores and the aluminum-containing support, and the dry thickness of the resulting third (innermost) aluminum oxide layer is less than 5% of the thickness of the inner aluminum oxide layer formed during the second anodizing process.

A suitable aluminum-containing plate having an electrochemically or mechanically grained and etched planar surface is subjected to a first anodizing process to form an outer aluminum oxide layer on that electrochemically or mechanically grained and etched planar surface. The first anodizing process can be carried out in an electrolyte composition containing at least 100 g/liter and up to and including 350 g/liter of phosphoric acid, and a suitable amount of aluminum ions, for example 5 g/liter at 35° C. up to and including 70° C., and using a direct current (DC) electricity supply to sustain an anodizing voltage of at least 10 up to 20 volts over a period of time sufficient to provide un outer aluminum oxide layer having a thickness of at least 130 nm and up to and including 650 nm. Representative details of such first anodizing process are illustrated in the working Examples described below.

The resulting outer aluminum oxide layer should comprise a multiplicity of outer micropores having an average outer micropore diameter ($D_o$) of at least 15 nm and up to and including 30 nm. In addition, the average dry thickness ($T_o$) of the outer aluminum oxide layer is at least 130 nm and up to and including 650 nm or is more likely at least 130 nm and up to and including 400 nm. The micropore density ($C_o$) of the outer anodizing layer is generally at least 500 micropores/$\mu m^2$ and up to and including 3,000 micropores/$\mu m^2$.

Moreover, the average outer micropore diameter ($D_o$) in nanometers and the micropore density ($C_o$) in micropores/$\mu m^2$ of the outer aluminum oxide layer are further constrained or related according to either of the following equations:

$$0.3 \leq P_o \leq 0.8 \text{ or}$$

$$0.3 \leq P_o \leq 0.6,$$

wherein $P_o$ is defined above.

Once the first anodizing process has been carried out for the desired time, the formed outer aluminum oxide layer can be rinsed, if desired, with a suitable solution such as water at a suitable temperature and time to remove residual acid and aluminum, and to stop the first anodizing process.

Unlike some processes known in the art, such as U.S. Patent Application Publication 2013/0052582 (Hayashi), the method of the present invention does not include what is known in the art as a "pore widening" (or micropore widening) step following anodization. Thus, such treatments are not purposely used in the practice of the present invention.

The second anodizing process is then carried out to form an inner aluminum oxide layer underneath the outer aluminum oxide layer, using a suitable electrolyte composition that can comprise at least 100 g/liter and up to and including 350 g/liter of sulfuric acid as well as a suitable amount of aluminum, for example 5 g/liter. These solution amounts can be optimized as to acid concentration, aluminum concentration, dwell time, and temperature in order to achieve the desired inner aluminum oxide layer properties as described herein. The details of such second anodizing process are illustrated in the working Examples described below.

The resulting inner aluminum oxide layer disposed on the grained and etched planar surface of the substrate should comprise a multiplicity of inner micropores having an average inner micropore diameter ($D_i$) of less than 15 nm and typically less than or equal to 10 nm. In addition, the average dry thickness ($T_i$) of the inner aluminum oxide layer is at least 650 nm or at least 700 nm, and up to and including 1500 nm, or up to and including 3,000 nm.

In addition, it is highly important that the ratio of the average outer micropore diameter ($D_o$) be greater than the average inner micropore diameter ($D_i$), for example, the ratio of $D_o$ to $D_i$ is greater than 1.1:1, or even greater than 1.5:1, and typically, greater than 2:1.

Once the second anodizing process is carried out for a desired time, both formed outer aluminum oxide layer and inner aluminum oxide layer can be rinsed, if desired, with a suitable solution such as water, at a suitable temperature and time to remove residual acid and aluminum, and to stop the second anodizing process.

While it is not essential, it is usually desirable to provide a hydrophilic coating on the outer aluminum oxide layer. When used, the hydrophilic coating can be provided from a hydrophilic coating formulation comprising one or more hydrophilic polymers to provide a dry coverage of the hydrophilic coating of at least 0.0002 g/$m^2$ and up to and including 0.1 g/$m^2$ or in an amount of at least 0.005 g/$m^2$ and up to and including 0.08 g/$m^2$. Due to porous nature of the aluminum oxide layers, at least part of the applied hydrophilic coating is located inside the aluminum oxide pores. $T_o$ achieve the maximum durability of the imaged printing plate precursor of the present invention while maintaining good developability on press, it is particularly preferred that the aluminum oxide pores are not completely filled. $T_o$ check whether the aluminum oxide pores are completely filled or not, one can use a suitable test known in the art, such as acid dye staining test. Useful hydrophilic polymers include but are not limited to, homopolymers and copolymers derived at least in part from any of acrylic acid, methacrylic acid, methacrylamide, acrylamide, vinyl phosphoric acid dimethyl ester, and vinyl phosphonic acid, and combinations thereof. Particularly useful hydrophilic polymers comprise recurring units derived from either acrylic acid or methacrylic acid, or both. Hydrophilic polymers derived from acidic monomers such as acrylic acid and methacrylic acid can be neutralized to various degrees. Useful hydrophilic polymers can be purchased from a number of commercial sources or prepared using known ethylenically unsaturated polymerizable monomers and polymerization reaction conditions. The hydrophilic coating and the hydrophilic coating formulation can contain additives such as inorganic acid (for example, phosphoric acid in an amount of at least 0.01 weight %), salts of inorganic acids, and surfactants. A particularly useful hydrophilic coating formulation is described below in relation to the working Examples.

The post-treatment process can be carried out in any suitable manner as described for examples in [0058]-[0061] of U.S. Patent Application Publication 2014/0047993 (note above). Alternatively, the post-treatment process can be carried out by coating a desired amount of the hydrophilic coating formulation in a suitable solvent such as water directly onto the outer aluminum oxide layer and then drying the resulting wet coating.

After all these essential and optional treatments, the resulting inventive substrates, in any suitable form such as flat sheets or continuous webs or coils, are ready for the preparation of lithographic printing plate precursors according to the present invention.

Radiation-Sensitive Imagable Layers and Precursors

One or more negative-working, infrared radiation-sensitive imagable layers can be formed on the outer aluminum oxide layer (or on the hydrophilic coating if present) in a suitable manner using suitable infrared radiation-sensitive imagable layer formulations as described in more detail below.

Negative-Working Lithographic Printing Plate Precursors:

The precursors used in the present invention can be formed by suitable application of a negative-working infrared radiation-sensitive composition as described below to a suitable substrate (as described above) to form a negative-working, infrared radiation-sensitive imagable layer on that substrate. In general, the negative-working, infrared radiation-sensitive composition (and resulting negative-working, infrared radiation-sensitive imagable layer) comprises (a) one or more free radically polymerizable components, (b) an initiator composition that provides free radicals upon exposure to imaging radiation, and (c) one or more infrared radiation absorbers, as essential components, and optionally, a polymeric binder different from all of (a), (b), and (c), all of which essential and optional components are described in more detail below. There is generally only a single negative-working, infrared radiation-sensitive imagable layer in the precursor. It is generally the outermost layer in the precursor, but in some embodiments, there can be an outermost water-soluble hydrophilic overcoat (also known as a topcoat or oxygen barrier layer) disposed over the negative-working, infrared radiation-sensitive imagable layer.

It is particularly useful to design the components of the negative-working, infrared radiation-sensitive imagable layer in such a manner (types and forms of chemical compounds and amounts of each) that after imagewise exposure, it is on-press developable using a lithographic printing ink, a fountain solution, or a combination of a lithographic printing ink and a fountain solution. More details of on-press developability are described below.

The negative-working, infrared radiation-sensitive composition (and negative-working, infrared radiation-sensitive imagable layer prepared therefrom) comprises (a) one or more free radically polymerizable components, each of which contains one or more free radically polymerizable groups (and two or more of such groups in some embodiments) that can be polymerized using free radical initiation. In some embodiments, the negative-working, infrared radiation-sensitive imagable layer comprises two or more free radically polymerizable components having the same or different numbers of free radically polymerizable groups in each molecule.

Useful free radically polymerizable components can contain one or more free radical polymerizable monomers or oligomers having one or more addition polymerizable ethylenically unsaturated groups (for example, two or more of such groups). Similarly, crosslinkable polymers having such free radically polymerizable groups can also be used. Oligomers or prepolymers, such as urethane acrylates and methacrylates, epoxide acrylates and methacrylates, polyester acrylates and methacrylates, polyether acrylates and methacrylates, and unsaturated polyester resins can be used. In some embodiments, the free radically polymerizable component comprises carboxyl groups.

It is possible for one or more free radically polymerizable components to have large enough molecular weight to enhance the mechanical properties of the negative-working, infrared radiation-sensitive imagable layer and thus make the corresponding lithographic printing plate precursors suitable for transportation in typical packaging and for handling during normal prepress operation. It is also possible for one or more free radically polymerizable components to be present in the negative-working, infrared radiation-sensitive layer as a particulate material, the components having a particle size of at least 10 nm and up to and including 800 nm. In such embodiments, a separate non-polymerizable or non-crosslinkable polymer binder (described below) is not necessary but may still be present.

Free radically polymerizable components include urea urethane (meth)acrylates or urethane (meth)acrylates having multiple (two or more) polymerizable groups. Mixtures of such compounds can be used, each compound having two or more unsaturated polymerizable groups, and some of the compounds having three, four, or more unsaturated polymerizable groups. For example, a free radically polymerizable component can be prepared by reacting DESMODUR® N100 aliphatic polyisocyanate resin based on hexamethylene diisocyanate (Bayer Corp., Milford, Conn.) with hydroxyethyl acrylate and pentaerythritol triacrylate. Useful free radically polymerizable compounds include NK Ester A-DPH (dipentaerythritol hexaacrylate) that is available from Kowa American, and Sartomer 399 (dipentaerythritol pentaacrylate), Sartomer 355 (di-trimethylolpropane tetraacrylate), Sartomer 295 (pentaerythritol tetraacrylate), and Sartomer 415 [ethoxylated (20)trimethylolpropane triacrylate] that are available from Sartomer Company, Inc.

Numerous other free radically polymerizable components are known in the art and are described in considerable literature including *Photoreactive Polymers: The Science and Technology of Resists*, A Reiser, Wiley, New York, 1989, pp. 102-177, by B. M. Monroe in *Radiation Curing: Science and Technology*, S. P. Pappas, Ed., Plenum, New York, 1992, pp. 399-440, and in "Polymer Imaging" by A. B. Cohen and P. Walker, in *Imaging Processes and Material*, J. M. Sturge et al. (Eds.), Van Nostrand Reinhold, New York, 1989, pp. 226-262. For example, useful free radically polymerizable components are also described in EP 1,182,033A1 (Fujimaki et al.), beginning with paragraph [0170], and in U.S. Pat. No. 6,309,792 (Hauck et al.), U.S. Pat. No. 6,569,603 (Furukawa), and U.S. Pat. No. 6,893,797 (Munnelly et al.) the disclosures of all of which are incorporated herein by reference. Other useful free radically polymerizable components include those described in U.S. Patent Application Publication 2009/0142695 (Baumann et al.), which radically polymerizable components include 1H-tetrazole groups, the disclosure of which is incorporated herein by reference.

Useful free radically polymerizable components as described above can be readily obtained from various commercial sources or prepared using known starting materials and synthetic methods.

The (a) one or more free radically polymerizable components are generally present in a negative-working, infrared radiation-sensitive imagable layer in an amount of at least 10 weight % and up to and including 70 weight %, or typically of at least 20 weight % and up to and including 50 weight %, all based on the total dry weight of the negative-working, infrared radiation-sensitive imagable layer.

The negative-working, infrared radiation-sensitive imagable layer used in the present invention also comprises includes (b) an initiator composition that provides free radicals in the presence of a suitable radiation absorber, upon exposure of the negative-working, infrared radiation-sensitive imagable layer to suitable imaging infrared radiation to initiate the polymerization of the one or more free radically polymerizable components. The initiator composition can be a single compound or a combination or system of a plurality of compounds.

Useful initiator compositions for negative-working, infrared radiation-sensitive compositions and imagable layers include but are not limited to, onium salts such as ammonium, iodonium, sulfonium, and phosphonium compounds that are described in detail in [0131] of U.S. Patent Application Publication 2014/0047993 (noted above), and references cited therein, the disclosures of which are incorporated herein by reference. Examples of the onium salts include triphenylsulfonium, diphenyliodonium, diphenyldiazonium, and derivatives obtained by introducing one or more substituents into the benzene ring of these compounds. Suitable substituents include but are not limited to, alkyl, alkoxy, alkoxycarbonyl, acyl, acyloxy, chloro, bromo, fluoro and nitro groups.

Examples of anions in the onium salts include but are not limited to, halogen anions, $ClO_4^-$, $PF_6^-$, $BF_4^-$, $SbF_6^-$, $CH_3SO_3^-$, $CF_3SO_3^-$, $C_6H_5SO_3^-$, $CH_3C_6H_4SO_3^-$, $HOC_6H_4SO_3^-$, $ClC_6H_4SO_3^-$, and boron anion as described for example in U.S. Pat. No. 7,524,614 (Tao et al.), the disclosure of which is incorporated herein by reference.

The onium salt can be a polyvalent onium salt having at least two onium ion atoms in the molecule that are bonded through a covalent bond. Among polyvalent onium salts, those having at least two onium ion atoms in the molecule are useful and those having a sulfonium or iodonium cation in the molecule are particularly useful. Representative polyvalent onium salts are represented by the following formulas (6) and (7):)

(6)

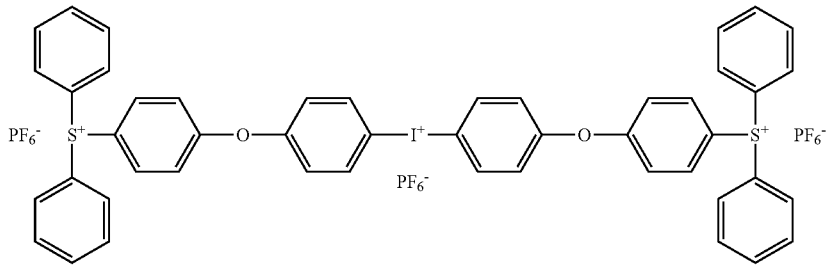

(7)

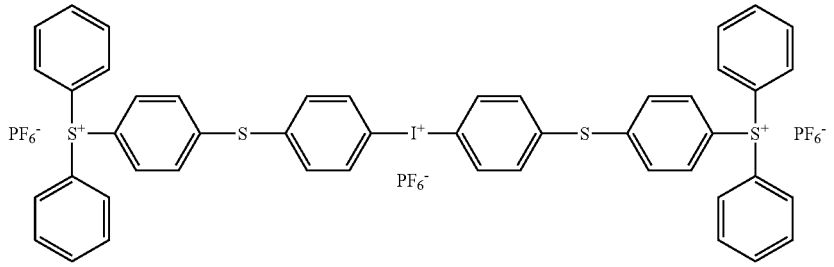

Furthermore, the onium salts described in paragraphs [0033] to [0038] of the specification of Japanese Patent Publication 2002-082429 [or U.S. Patent Application Publication 2002-0051934 (Ippei et al.), the disclosure of which is incorporated herein by reference] or the iodonium borate complexes described in U.S. Pat. No. 7,524,614 (noted above), can also be used in the present invention.

In some embodiments, the initiator composition can comprise a combination of initiator compounds such as a combination of iodonium salts, for example the combination of Compound A and Compound B described as follows.

Compound A can be represented by Structure (I) shown below, and the one or more compounds collectively known as compound B can be represented below by either Structure (II) or (III):

(I)

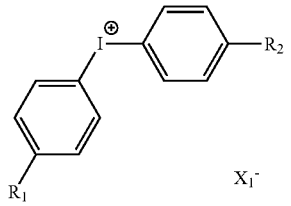

(II)

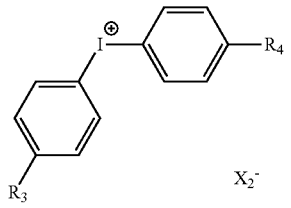

-continued (III)

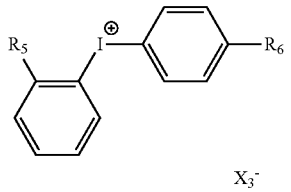

In these Structures (I), (II), and (III), $R_1$, $R_2$, $R_3$, $R_4$, $R_5$ and $R_6$ are independently substituted or unsubstituted alkyl groups or substituted or unsubstituted alkoxy groups, each of these alkyl or alkoxy groups having from 2 to 9 carbon atoms (or particularly from 3 to 6 carbon atoms). These substituted or unsubstituted alkyl and alkoxy groups can be in linear or branched form. In many useful embodiments, $R_1$, $R_2$, $R_3$, $R_4$, $R_5$ and $R_6$ are independently substituted or unsubstituted alkyl groups, such as independently chosen substituted or unsubstituted alkyl groups having 3 to 6 carbon atoms.

In addition, at least one of $R_3$ and $R_4$ can be different from $R_1$ or $R_2$; the difference between the total number of carbon atoms in $R_1$ and $R_2$ and the total number of carbon atoms in $R_3$ and $R_4$ is 0 to 4 (that is, 0, 1, 2, 3, or 4); the difference between the total number (sum) of carbon atoms in $R_1$ and $R_2$ and the total number (sum) of carbon atoms in $R_5$ and $R_6$ is 0 to 4 (that is, 0, 1, 2, 3, or 4); and $X_1$, $X_2$ and $X_3$ are the same or different anions.

Useful anions include but are not limited to, $ClO_4^-$, $PF_6^-$, $BF_4^-$, $SbF_6^-$, $CH_3SO_3^-$, $CF_3SO_3^-$, $C_6H_5SO_3^-$, $CH_3C_6H_4SO_3^-$, $HOC_6H_4SO_3^-$, $ClC_6H_4SO_3^-$, and borate anions represented by the following Structure (IV):

$$B^-(R^1)(R^2)(R^3)(R^4) \quad \text{(IV)}$$

wherein $R^1$, $R^2$, $R^3$, and $R^4$ independently represent substituted or unsubstituted alkyl, substituted or unsubstituted aryl (including halogen-substituted aryl groups), substituted or unsubstituted alkenyl, substituted or unsubstituted alkynyl, substituted or unsubstituted cycloalkyl, or substituted or unsubstituted heterocyclic groups, or two or more of $R^1$, $R^2$, $R^3$, and $R^4$ can be joined together to form a substituted or unsubstituted heterocyclic ring with the boron atom, such rings having up to 7 carbon, nitrogen, oxygen, or nitrogen atoms. The optional substituents on $R^1$, $R^2$, $R^3$, and $R^4$ can include chloro, fluoro, nitro, alkyl, alkoxy, and acetoxy groups. In some embodiments, all of the $R^1$, $R^2$, $R^3$, and $R^4$ are the same or different substituted or unsubstituted aryl groups such as substituted or unsubstituted phenyl groups, or more likely all of these groups are unsubstituted phenyl groups. In many embodiments, at least one of $X_1$, $X_2$, and $X_3$ is a tetraarylborate anion comprising the same or different aryl groups, or in particularly useful embodiments, one or more is a tetraphenylborate anion or each of $X_1$, $X_2$, and $X_3$ is a tetraphenylborate anion.

Mixtures of Compound B compounds represented by Structures (II) or (III) can be used if desired. Many useful compounds represented by Structures (I), (II), and (III) can be obtained from commercial sources such as Sigma-Aldrich or they can be prepared using known synthetic methods and readily available starting materials.

Components useful in the initiator compositions described above can be obtained from various commercial sources or prepared using known synthetic methods and starting materials.

The initiator composition is generally present in the negative-working, infrared radiation-sensitive imagable layer sufficient to provide one or more polymerization initiators in an amount of at least 0.5 weight % and up to and including 20 weight %, or typically of at least 2 weight % and up to and including 15 weight %, or even of at least 4 weight % and up to and including 12 weight %, all based on the total dry weight of the negative-working, infrared radiation-sensitive imagable layer.

In addition, the negative-working, infrared radiation-sensitive imagable layer also comprises (c) one or more infrared radiation absorbers to provide desired radiation sensitivity or to convert radiation to heat, or both.

The negative-working, infrared radiation-sensitive imagable layer comprises one or more infrared radiation absorbers to provide desired infrared radiation sensitivity. Useful infrared radiation absorbers can be pigments or infrared radiation absorbing dyes. Suitable dyes also can be those described in for example, U.S. Pat. No. 5,208,135 (Patel et al.), U.S. Pat. No. 6,153,356 (Urano et al.), U.S. Pat. No. 6,309,792 (Hauck et al.), U.S. Pat. No. 6,569,603 (Furukawa), U.S. Pat. No. 6,797,449 (Nakamura et al.), U.S. Pat. No. 7,018,775 (Tao), U.S. Pat. No. 7,368,215 (Munnelly et al.), U.S. Pat. No. 8,632,941 (Balbinot et al.), and U.S. Patent Application Publication 2007/056457 (Iwai et al.), the disclosures of all of which are incorporated herein by reference. In some infrared radiation-sensitive embodiments, it is desirable that at least one infrared radiation absorber in the infrared radiation-sensitive imagable layer be a cyanine dye comprising a tetraarylborate anion such as a tetraphenylborate anion. Examples of such dyes include those described in United States Patent Application Publication 2011/003123 (Simpson et al.) the disclosure of which is incorporated herein by reference.

In addition to low molecular weight IR-absorbing dyes, IR dye chromophores bonded to polymers can be used as well. Moreover, IR dye cations can be ionically associated with a polymer comprising anionic side chains such as carboxy, sulfo, phospho, or phosphono groups.

Useful radiation absorbers described above can be readily obtained from various commercial sources or prepared using known starting materials and synthetic methods.

The total amount of one or more infrared radiation absorbers in the negative-working, infrared radiation-sensitive imagable layer is at least 0.5 weight % and up to and including 30 weight %, or typically of at least 1 weight % and up to and including 15 weight %, based on the total dry weight of the negative-working, infrared radiation-sensitive imagable layer.

It is optional but desirable in many embodiments that the negative-working, infrared radiation-sensitive imagable layer further comprise one or more (d) polymeric binders to achieve certain mechanical properties of the imagable layer. Such polymeric binders are different from all of the (a), (b), and (c) materials described above. These polymeric binders are particularly desired when none of (a), (b), and (c) materials are polymeric.

Such (d) polymeric binders can be selected from a number of polymeric binder materials known in the art including polymers comprising recurring units having side chains comprising polyalkylene oxide segments such as those described in for example, U.S. Pat. No. 6,899,994 (Huang et al.) the disclosure of which is incorporated herein by reference. Other useful (d) polymeric binders comprise two or more types of recurring units having different side chains comprising polyalkylene oxide segments as described in for example WO Publication 2015-156065 (Kamiya et al.). Some of such (d) polymeric binders can further comprise recurring units having pendant cyano groups as those described in for example U.S. Pat. No. 7,261,998 (Hayashi et al.) the disclosure of which is incorporated herein by reference.

Some useful (d) polymeric binders can be present in particulate form, that is, in the form of discrete, non-agglomerated particles. Such discrete particles can have an average particle size of at least 10 nm and up to and including 1500 nm, or typically of at least 80 nm and up to and including 600 nm and are generally distributed uniformly within the negative-working, infrared radiation-sensitive imagable layer. For example, one or more useful (d) polymeric binders can be present in the form of particles having an average particle size of at least 50 nm and up to and including 400 nm. Average particle size can be determined by various known methods including measuring the particles in electron scanning microscope images and averaging a set number of measurements.

In some embodiments, the (d) polymeric binder is present in the form of particles having an average particle size that is less than the average dry thickness (t) of the negative-working, infrared radiation-sensitive imagable layer. The average dry thickness (t) in micrometers (μm) is calculated by the following Equation:

$$t=w/r$$

wherein w is the dry coating coverage of the negative-working, infrared radiation-sensitive imagable layer in $g/m^2$ and r is 1 $g/cm^3$. For example, in such embodiments, the (d) polymeric binder can comprise at least 0.05% and up to and including 80%, or more likely at least 10% and up to and including 50%, of the negative-working, infrared radiation-sensitive imagable layer.

The (d) polymeric binders also can have a backbone comprising multiple (at least two) urethane moieties as well as pendant groups comprising the polyalkylenes oxide segments.

Other useful (d) polymeric binders can comprise polymerizable groups such as acrylate ester, methacrylate ester, vinyl aryl, and allyl groups and as well as alkali soluble groups such as carboxylic acid. Some of these useful (d) polymeric binders are described in U.S. Patent Application Publication 2015/0099229 (Simpson et al.) and U.S. Pat. No. 6,916,595 (Fujimaki et al.), the disclosures of both of which are incorporated herein by reference.

Useful (d) polymeric binders generally have a weight average molecular weight (Mw) of at least 2,000 and up to and including 500,000, or at least 20,000 and up to and including 300,000, as determined by Gel Permeation Chromatography (polystyrene standard).

Useful (d) polymeric binders can be obtained from various commercial sources or they can be prepared using known procedures and starting materials, as described for example in publications described above.

The total (d) polymeric binders can be present in the negative-working, infrared radiation-sensitive imagable layer in an amount of at least 10 weight % and up to and including 70 weight %, or more likely in an amount of at least 20 weight % and up to and including 50 weight %, based on the total dry weight of the negative-working, infrared radiation-sensitive imagable layer.

Other polymeric materials known in the art (different from the (d) polymeric binders) can be present in the negative-working, infrared radiation-sensitive imagable layer and such polymeric materials are generally more hydrophilic or more hydrophobic than the (d) polymeric binders described above. Example of such hydrophilic polymeric binders include but are not limited to, cellulose derivatives such as hydroxypropyl cellulose, carboxymethyl cellulose, and polyvinyl alcohol with various degrees of saponification. More hydrophobic polymeric binders are less developable than the (d) polymeric binders described above and typically have an acid value less than 20 mg KOH/g for all acidic groups having a pKa below 7 and their corresponding salts. Such hydrophobic polymeric binders typically contain less than 10 weight %, more typically less than 5 weight %, segments that contribute to the hydrophilicity of the binder and are selected from the group consisting of hydroxyl group, —($CH_2CH_2$—O)— and —C(=O)$NH_2$. Examples of such hydrophobic polymeric binders include but are not limited to, poly(methyl methacrylate), poly (benzyl methacrylate), and polystyrene.

Additional optional additives to the negative-working, infrared radiation-sensitive imagable layer can include organic dyes or organic dye precursors and color developers as are known in the art. Useful organic dyes or organic dye precursors include but are not limited to, phthalide and fluoran leuco dyes having a lactone skeleton with an acid dissociable lactone skeleton, such as those described in U.S. Pat. No. 6,858,374 (Yanaka), the disclosure of which is incorporated herein by reference. Such optional additives can be used as print-out colorants and can be present in an amount of at least 1 weight % and up to and including 10 weight %, based on the total dry weight of the negative-working, infrared radiation-sensitive imagable layer. Other useful print-out colorants are known in the art and can include azo dyes, triarylmethane dyes, cyanine dyes, and spirolactone or spirolactam colorants as described for example in U.S. Patent Application Publication 2009/0047599 (Home et al.).

The negative-working, infrared radiation-sensitive imagable layer can include crosslinked polymer particles having an average particle size of at least 2 μm, or of at least 4 μm, and up to and including 20 μm as described for example in U.S. Pat. No. 8,383,319 (Huang et al.), U.S. Pat. No. 8,105,751 (Endo et al), and U.S. Pat. No. 9,366,962 (Kamiya et al.), the disclosures of all of which are incorporated herein by reference. Such crosslinked polymeric particles can be present only in the negative-working, infrared radiation-sensitive imagable layer, only in the hydrophilic overcoat when present (described below), or in both the negative-working, infrared radiation-sensitive imagable layer and the hydrophilic overcoat when present.

The negative-working, infrared radiation-sensitive imagable layer can also include a variety of other optional addenda including but not limited to, dispersing agents, humectants, biocides, plasticizers, surfactants for coatability or other properties, viscosity builders, pH adjusters, drying agents, defoamers, preservatives, antioxidants, development aids, rheology modifiers, or combinations thereof, or any other addenda commonly used in the lithographic art, in conventional amounts. The negative-working, infrared radiation-sensitive imagable layer can also include a phosphate (meth)acrylate having a molecular weight generally greater than 250 as described in U.S. Pat. No. 7,429,445 (Munnelly et al.) the disclosure of which is incorporated herein by reference.

Hydrophilic Overcoat:

While in some embodiments of the negative-working lithographic printing plate precursors, the negative-working, infrared radiation-sensitive imagable layer is the outermost layer with no layers disposed thereon, it is possible that the precursors can be designed with a hydrophilic coating (also known in the art as a hydrophilic overcoat, oxygen-barrier layer, or topcoat) disposed directly on the negative-working, infrared radiation-sensitive imagable layer (no intermediate layers between these two layers). When present, this hydrophilic overcoat is generally the outermost layer of the precursor.

Such hydrophilic overcoats can comprise one or more film-forming water-soluble polymeric binders in an amount of at least 60 weight % and up to and including 100 weight %, based on the total dry weight of the hydrophilic overcoat. Such film-forming water-soluble (or hydrophilic) polymeric binders can include a modified or unmodified poly(vinyl alcohol) having a saponification degree of at least 30%, or a degree of at least 75%, or a degree of at least 90%, and a degree of up to and including 99.9%.

Further, one or more acid-modified poly(vinyl alcohol)s can be used as film-forming water-soluble (or hydrophilic) polymeric binders in the hydrophilic overcoat. For example, at least one modified poly(vinyl alcohol) can be modified with an acid group selected from the group consisting of carboxylic acid, sulfonic acid, sulfuric acid ester, phosphonic acid, and phosphoric acid ester groups. Examples of such materials include but are not limited to, sulfonic acid-modified poly(vinyl alcohol), carboxylic acid-modified poly (vinyl alcohol), and quaternary ammonium salt-modified poly(vinyl alcohol), glycol-modified poly(vinyl alcohol), or combinations thereof.

The hydrophilic overcoat can also include crosslinked polymer particles having an average particle size of at least 2 μm and as described for example in U.S. Pat. No. 8,383,319 (Huang et al.) and U.S. Pat. No. 8,105,751 (Endo et al), the disclosures of both of which are incorporated herein by reference.

The hydrophilic overcoat can be provided at a dry coating coverage of at least 0.1 $g/m^2$ and up to but less than 4 $g/m^2$, and typically at a dry coating coverage of at least 0.15 $g/m^2$ and up to and including 2.5 $g/m^2$. In some embodiments, the dry coating coverage is as low as 0.1 $g/m^2$ and up to and including 1.5 $g/m^2$ or at least 0.1 $g/m^2$ and up to and including 0.9 $g/m^2$, such that the hydrophilic overcoat is relatively thin.

The hydrophilic overcoat can optionally comprise organic wax particles dispersed within the one or more film-forming water-soluble (or hydrophilic) polymeric binders as described for example in U.S. Patent Application Publication 2013/0323643 (Balbinot et al.) the disclosure of which is incorporated herein by reference.

Making Lithographic Printing Plate Precursors

The on-press developable, negative-working lithographic printing plate precursors described herein can be provided in the following manner. A negative-working, infrared radiation-sensitive imagable layer formulation comprising materials described above can be applied to the inventive substrate, usually in a continuous substrate roll or web, as described above using any suitable equipment and procedure, such as knife coating, gravure coating, die coating, slot coating, bar coating, wire rod coating, roller coating, or extrusion hopper coating. The negative-working, infrared radiation-sensitive imagable layer formulation can also be applied by spraying onto a suitable substrate. Typically, once the negative-working, infrared radiation-sensitive imagable layer formulation is applied at a suitable wet coverage, it is dried in a suitable manner known in the art to provide a desired dry coverage as noted below, thereby providing an infrared radiation-sensitive continuous article that can be in any suitable form such as a web from which individual precursors can be prepared using known manufacturing processes.

The manufacturing methods typically include mixing the various components needed for a particular infrared radiation-sensitive imagable layer chemistry in a suitable organic solvent or mixtures thereof [such as methyl ethyl ketone (2-butanone), methanol, ethanol, 1-methoxy-2-propanol, iso-propyl alcohol, acetone, γ-butyrolactone, n-propanol, tetrahydrofuran, and others readily known in the art, as well as mixtures thereof], applying the resulting negative-working, infrared radiation-sensitive imagable layer formulation to the continuous substrate web, and removing the solvent(s) by evaporation under suitable drying conditions.

After proper drying, the dry coverage of the negative-working infrared radiation-sensitive imagable layer on an inventive substrate is generally at least 0.1 $g/m^2$ and up to and including 4 $g/m^2$ or at least 0.4 $g/m^2$ and up to and including 2 $g/m^2$ but other dry coverage amounts can be used if desired.

As described above, in some negative-working precursor embodiments, a suitable aqueous-based hydrophilic overcoat formulation can be applied to the dried infrared radiation-sensitive imagable layer using known coating and drying conditions, equipment, and procedures.

In practical manufacturing conditions, the result of these coating operations is a continuous web or roll of radiation-sensitive lithographic printing plate precursor material having either one or more negative-working, infrared radiation-sensitive imagable layers and any optional layers noted above disposed on the inventive substrate described above.

Individual rectangular lithographic printing plate precursors are formed from this resulting continuous radiation-sensitive web or roll by slitting to create multiple longitudinal strips, each of which has a width equal to one dimension of rectangular on-press developable, negative-working lithographic printing plate precursors. A cutting-to-length process is used to create a lateral cut across each strip at an interval equal to the other dimension of rectangular lithographic printing plate precursors, thereby forming individual precursors having a square or rectangular form.

Imaging (Exposing) Conditions

During use, an on-press developable, negative-working radiation-sensitive lithographic printing plate precursor according to the present this invention is provided and imagewise exposed to a suitable source of exposing infrared radiation. An imaged lithographic printing plate precursor is thus formed, having infrared radiation exposed and infrared radiation non-exposed regions in an image surface of the negative-working, infrared radiation-sensitive imagable layer. For example, such precursors can be imaged with infrared lasers that emit significant radiation within the range of at least 750 nm and up to and including 1400 nm, or of at least 800 nm and up to and including 1250 nm.

Imaging can be carried out using imaging or exposing radiation from an infrared radiation-generating laser (or array of such lasers). Imaging also can be carried out using imaging infrared radiation at multiple wavelengths at the same time if desired, for example, using multiple infrared radiation wavelengths. The laser used to expose the precursor is usually a diode laser, because of the reliability and low maintenance of diode laser systems, but other lasers such as gas or solid-state lasers can also be used. The combination of power, intensity and exposure time for radiation imaging would be readily apparent to one skilled in the art.

The imaging apparatus can be configured as a flatbed recorder or as a drum recorder, with the on-press developable, negative-working radiation-sensitive lithographic printing plate precursor mounted to the interior or exterior cylindrical surface of the drum. An example of useful infrared imaging apparatus is available as models of KODAK® Trendsetter platesetters (Eastman Kodak Company) and NEC AMZISetter X-series (NEC Corporation, Japan) that contain laser diodes that emit radiation at a wavelength of about 830 nm. Other suitable infrared imaging apparatus includes the Screen PlateRite 4300 series or 8600 series platesetters (available from Screen USA, Chicago, Ill.) or thermal CTP platesetters from Panasonic Corporation (Japan) that operate at a wavelength of 810 nm.

Infrared radiation imaging energies can be at least 30 mJ/cm$^2$ and up to and including 500 mJ/cm$^2$ and typically at least 50 mJ/cm$^2$ and up to and including 300 mJ/cm$^2$ depending upon the sensitivity of the infrared radiation-sensitive imagable layer.

Processing (Development) and Printing

After imagewise exposing, processing and printing are carried out by mounting the imaged negative-working radiation-sensitive lithographic printing plate precursor on a lithographic printing press. This processing on-press is designed to remove the infrared radiation non-exposed regions and any hydrophilic overcoat if present, while leaving intact the hardened infrared radiation exposed regions.

On-press development can be carried out using a lithographic printing ink, a fountain solution, or a combination of a lithographic printing ink and a fountain solution. In such embodiments, an imaged negative-working, infrared radiation-sensitive lithographic printing plate precursor according to the present invention is mounted onto a printing press and the printing operation is begun. The non-exposed regions in the negative-working, infrared radiation-sensitive imagable layer are removed by a suitable fountain solution, lithographic printing ink, or a combination of both, when the initial printed impressions are made. Typical ingredients of aqueous fountain solutions include pH buffers, desensitizing agents, surfactants and wetting agents, humectants, low boiling solvents, biocides, antifoaming agents, and sequestering agents. A representative example of a fountain solution is Varn Litho Etch 142W+Varn PAR (alcohol sub) (available from Varn International, Addison, Ill.).

A suitable lithographic printing press comprises a plate cylinder for holding an imaged lithographic printing plate precursor; an inking system capable of supplying lithographic printing ink to the imaged surface of the imaged lithographic printing plate precursor; a dampening system capable of supplying fountain solution to the imaged surface; a blanket cylinder capable of transferring the lithographic printing ink from the imaged lithographic printing plate precursor; an impression cylinder capable of pressing one or more printing papers (or other printable materials) onto the blanket cylinder, and thus transferring the lithographic printing ink from the blanket cylinder onto the one or more printing papers; and a printing paper feeding system for supplying the one or more printing papers to the impression cylinder. While the present invention is not limited to a specific model or commercially available lithographic printing press, some useful lithographic printing presses are commercially available as Heidelberg Speedmaster 74 and Speedmaster XL105 available from Heidelberg USA (1000 Gutenberg Drive, Kennesaw, Ga. 30144), KBA Rapida 105 available Koenig & Bauer (US) (2555 Regent Boulevard Dallas, Tex. 75261), Komori Lithrone G40 available from Komori America (5520 Meadowbrook Industrial Court, Rolling Meadows, Ill. 60008). Illustrations of useful lithographic printing presses and their operation are described for example, in Chapter 12 of the book of "Printing Technology, the 4$^{th}$ addition", by J. Michael Adams, David D. Faux, Lloyd J. Rieber, Delmar Publishers, Inc.

In a typical printing press startup with a sheet-fed printing machine, the dampening roller is engaged first and supplies fountain solution to the mounted imaged precursor to swell the imaged negative-working, infrared radiation-sensitive imagable layer at least in the non-exposed regions. After a few revolutions, the inking rollers are engaged, and they supply lithographic printing ink(s) to cover the entire printing surface of the imaged lithographic printing precursors. Typically, from 1 to 15 revolutions of the plate cylinder are carried out after the inking roller engagement, and printing sheets are supplied to remove the non-infrared radiation non-exposed regions of the negative-working, infrared radiation-sensitive imagable layer from the lithographic printing plate as well as materials on a blanket cylinder if present, using the formed ink-fountain solution emulsion. The result is a fully developed, functioning lithographic printing plate as the printing press is operated beyond 15 revolutions of the plate cylinder. A target or desired number of lithographically printed papers can be produced with desired print quality because of the successful on-press developability of the unique negative-working infrared radiation-sensitive lithographic printing plate precursors used in the practice of this invention. Thus, the fully developed lithographic printing plate has ink-accepting image regions that substantially correspond to the infrared radiation exposed regions, and non-ink-accepting hydrophilic non-image regions that substantially correspond to the infrared radiation non-exposed regions.

On-press developability of infrared radiation exposed lithographic printing precursors is particularly useful when the precursor comprises one or more polymeric binders in an infrared radiation-sensitive imagable layer, at least one of which polymeric binders is present as particles having an average diameter of at least 50 nm and up to and including 400 nm.

The following Examples are provided to illustrate the practice of this invention and are not meant to be limiting in any manner.

Invention Examples 1-31

Inventive aluminum-containing substrates used in Invention Examples 1-31 were prepared according to the general processes described above. Hydro 1052 aluminum alloy strip or web (available from Norsk Hydro ASA, Norway) having a thickness of 0.28 mm was used as the aluminum-containing "plate" stock or support. Both pre-etch and post-etch steps were carried out in alkaline solutions under known conditions. Roughening (or graining) was carried out by electrochemical means in a hydrochloric acid solution at about 23° C. to obtain an arithmetic average roughness (Ra) of 0.5 μm on a planar surface of the aluminum-containing support. These treatment steps were carried out in a continuous process on a typical manufacturing line used to manufacture lithographic printing plate precursors. The resulting grained and etched aluminum-containing support was then rinsed with water, dried, and cut into individual grained and etched aluminum-containing sheets. Each individual sheet was then anodized twice wherein each anodizing process bath contained about 100 liters of anodizing solution. The first and second anodizing conditions for each of the Invention Examples 1-31 are shown below in TABLE I. The first anodizing process to form the outer aluminum oxide layer was carried out using phosphoric acid as the electrolyte and the second anodizing process to form the inner aluminum oxide layer was carried out using sulfuric acid as the electrolyte.

TABLE I

Conditions for First and Second Anodizing Processes

| | First Anodizing Treatment | | | | | Second Anodizing Treatment | | | | |
|---|---|---|---|---|---|---|---|---|---|---|
| Invention Example | Electrolyte conc. [g/liter] | Temperature [° C.] | Current density [A/dm$^2$] | Time [sec] | Charge density [C/dm$^2$] | Electrolyte conc. [g/liter] | Temperature [° C.] | Current density [A/dm$^2$] | Time [sec] | Charge density [C/dm$^2$] |
| 1 | 175 | 60 | 4.7 | 15.0 | 70.7 | 280 | 23 | 10.0 | 18.0 | 180.0 |
| 2 | 150 | 60 | 3.8 | 32.6 | 123.7 | 280 | 23 | 10.0 | 18.0 | 180.0 |
| 3 | 100 | 60 | 2.8 | 63.1 | 176.7 | 280 | 23 | 10.0 | 18.0 | 180.0 |
| 4 | 200 | 60 | 5.5 | 46.4 | 255.3 | 280 | 23 | 10.0 | 18.0 | 180.0 |
| 5 | 300 | 60 | 8.5 | 39.3 | 334.3 | 280 | 23 | 10.0 | 18.0 | 180.0 |
| 6 | 175 | 60 | 5.8 | 7.6 | 44.2 | 280 | 23 | 10.0 | 18.0 | 180.0 |
| 7 | 175 | 65 | 7.8 | 9.1 | 70.7 | 280 | 23 | 10.0 | 18.0 | 180.0 |
| 8 | 175 | 60 | 5.8 | 21.3 | 123.7 | 280 | 23 | 10.0 | 18.0 | 180.0 |
| 9 | 175 | 55 | 3.8 | 46.5 | 176.7 | 280 | 23 | 10.0 | 18.0 | 180.0 |
| 10 | 175 | 50 | 1.8 | 120.7 | 217.2 | 280 | 23 | 10.0 | 18.0 | 180.0 |
| 11 | 250 | 50 | 9.0 | 7.9 | 70.7 | 280 | 23 | 10.0 | 18.0 | 180.0 |
| 12 | 300 | 50 | 10.9 | 11.4 | 123.7 | 280 | 23 | 10.0 | 18.0 | 180.0 |
| 13 | 200 | 50 | 7.1 | 25.1 | 176.7 | 280 | 23 | 10.0 | 18.0 | 180.0 |
| 14 | 100 | 50 | 3.3 | 69.9 | 227.3 | 280 | 23 | 10.0 | 18.0 | 180.0 |
| 15 | 350 | 55 | 9.4 | 53.7 | 123.4 | 280 | 23 | 10.0 | 15.0 | 150.0 |
| 16 | 350 | 55 | 10.5 | 13.0 | 44.1 | 280 | 23 | 10.0 | 15.0 | 150.0 |
| 17 | 350 | 55 | 14.7 | 23.1 | 176.9 | 280 | 23 | 10.0 | 15.0 | 150.0 |
| 18 | 250 | 55 | 5.6 | 30.7 | 70.7 | 280 | 23 | 10.0 | 33.8 | 337.5 |
| 19 | 250 | 55 | 6.7 | 52.0 | 176.7 | 280 | 23 | 10.0 | 33.8 | 337.5 |
| 20 | 150 | 55 | 1.8 | 53.9 | 123.8 | 280 | 23 | 10.0 | 45.0 | 450.0 |
| 21 | 150 | 55 | 2.9 | 13.1 | 44.7 | 280 | 23 | 10.0 | 45.0 | 450.0 |
| 22 | 150 | 55 | 7.1 | 23.0 | 175.9 | 280 | 23 | 10.0 | 45.0 | 450.0 |
| 23 | 350 | 55 | 9.4 | 53.8 | 123.4 | 280 | 23 | 10.0 | 67.5 | 675.0 |
| 24 | 350 | 55 | 10.5 | 13.1 | 43.6 | 280 | 23 | 10.0 | 67.5 | 675.0 |
| 25 | 350 | 55 | 14.7 | 23.0 | 177.5 | 280 | 23 | 10.0 | 67.5 | 675.0 |
| 28 | 150 | 60 | 4.6 | 48.2 | 219.4 | 280 | 23 | 7.0 | 19.3 | 135.0 |
| 29 | 200 | 55 | 4.5 | 49.3 | 219.4 | 280 | 23 | 10.0 | 15.8 | 157.5 |
| 30 | 250 | 50 | 4.4 | 50.4 | 219.4 | 280 | 23 | 15.0 | 10.5 | 157.5 |
| 31 | 300 | 45 | 4.3 | 51.6 | 219.4 | 280 | 23 | 20.0 | 8.0 | 160.0 |

The micropore structure of each aluminum oxide layer provided by the first and second anodizing processes was evaluated by FE-SEM microscopy, performed on a Hitachi S4100 with a magnification of 50,000× to 150,000×. Top view SEM micrographs were taken perpendicular to the outer surface of the substrate. Cross-sectional SEM micrographs were taken parallel to the outer surface of the substrate by bending a small sample of each substrate by 180° and inspecting the breaking edge. The dry average layer thickness of each of the inner and outer aluminum oxide layers, $T_i$ and $T_o$, respectively, was measured from several cross-sectional images and the dry average layer thickness is shown below in TABLE II for each Invention Example substrate.

The inner micropore diameters of the inner aluminum oxide layer in the substrate were estimated from the cross-sectional SEM micrographs. The outer micropore diameters of the outer aluminum oxide was determined from the top view SEM micrographs. An average outer micropore diameter ($D_o$) was determined from 200 micropores in three top view SEM micrographs taken at different sample positions and is shown in TABLE II. It was confirmed that the average outer micropore diameter ($D_o$) of the outer aluminum oxide layer at its outer surface was essentially the same as the average outer micropore diameter ($D_o$) below that outer surface. This evaluation was carried out by taking additional top view SEM micrographs after removing the outermost 50 nm of the outer aluminum oxide layer by a sputtering treatment where the sputter beam ($Ar^+$ ions) was directed at a sample of the inventive substrate at an angle of 45° relative to the surface normal for a period of time. The sputtering treatment was repeated three times each after rotating the inventive substrate sample by 90° to achieve an even removal across the surface in the SEM viewing area.

FIG. 1 is an SEM image of a representative inventive substrate prepared according to the present invention, having both inner and outer anodizing layers. It is clear that $T_i$ is much greater than $T_o$.

The micropore density ($C_o$) of the outer aluminum oxide layer was determined by counting the micropores per projected surface area of the inventive substrate in the top view SEM micrographs. The porosity of the outer aluminum oxide layer is defined as the area in the top view SEM micrographs covered by micropores relative to the projected surface area parallel to the inventive substrate outermost surface. For micropore diameters smaller than 10 nm, the resolution of the SEM was not high enough to achieve reliable results and thus no information on the inner micropore density and the porosity of the inner aluminum oxide layer is provided.

TABLE II

Structural Features of the Outer and Inner Aluminum Oxide Layers

| | Outer Aluminum Oxide Layer | | | | Inner Aluminum Oxide Layer | |
|---|---|---|---|---|---|---|
| Invention Example | Average Dry Thickness ($T_o$) [nm] | Average Micropore Diameter ($D_o$) [nm] | Micropore Density [1/μm$^2$] ($C_o$) | Porosity [%] ($P_o$) | Average Dry Thickness ($T_i$) [nm] | Average Pore Diameter ($D_i$) [nm] |
| 1 | 201 | 18 | 2709 | 67 | 804 | <10 |
| 2 | 304 | 17 | 2784 | 64 | 813 | <10 |
| 3 | 350 | 18 | 2808 | 68 | 817 | <10 |
| 4 | 480 | 18 | 2667 | 65 | 804 | <10 |
| 5 | 595 | 18 | 2713 | 67 | 796 | <10 |
| 6 | 150 | 19 | 1308 | 39 | 809 | <10 |
| 7 | 207 | 22 | 1292 | 48 | 782 | <10 |
| 8 | 340 | 23 | 1223 | 49 | 797 | <10 |
| 9 | 490 | 23 | 1223 | 52 | 803 | <10 |
| 10 | 580 | 23 | 1225 | 51 | 811 | <10 |
| 11 | 220 | 30 | 593 | 41 | 796 | <10 |
| 12 | 330 | 29 | 620 | 40 | 772 | <10 |
| 13 | 490 | 28 | 605 | 37 | 821 | <10 |
| 14 | 607 | 30 | 582 | 41 | 817 | <10 |
| 15 | 286 | 19 | 2780 | 77 | 663 | <10 |
| 16 | 155 | 20 | 1264 | 39 | 670 | <10 |
| 17 | 515 | 29 | 573 | 39 | 673 | <10 |
| 18 | 199 | 18 | 2620 | 63 | 1499 | <10 |
| 19 | 481 | 22 | 1317 | 52 | 1463 | <10 |
| 20 | 316 | 18 | 2799 | 75 | 1966 | <10 |
| 21 | 151 | 22 | 1244 | 48 | 2019 | <10 |
| 22 | 510 | 28 | 601 | 38 | 2043 | <10 |
| 23 | 306 | 17 | 2773 | 61 | 2944 | <10 |
| 24 | 165 | 20 | 1232 | 40 | 2922 | <10 |
| 25 | 525 | 26 | 572 | 30 | 2966 | <10 |
| 28 | 619 | 21 | 1567 | 55 | 686 | <10 |
| 29 | 605 | 22 | 1540 | 60 | 693 | <10 |
| 30 | 608 | 21 | 1473 | 50 | 697 | <10 |
| 31 | 608 | 19 | 1561 | 43 | 711 | <10 |

Each of the grained, etched, and anodized substrates thus obtained was further treated to provide a hydrophilic coating over the outer aluminum oxide layer using a hydrophilic coating formulation having the components shown in the following TABLE III, which was applied using a bar coater; dried at 120° C. for 40 seconds; and then cooled to 20-27° C., resulting in a hydrophilic coating dry coverage of 0.03 g/m$^2$.

TABLE III

Hydrophilic Coating Formulation

| Component | Amount (g) |
|---|---|
| Polyacrylic acid (PAA) aqueous solution (40 weight %) (obtained as Jurymer AC-10S, marketed by TOAGOSEI) | 3.0 |
| Water | 27.0 |

Lithographic printing plate precursors were prepared according to the present invention in Invention Examples 1-31 by coating the corresponding inventive substrate described above with a negative-working, radiation-sensitive imagable layer formulation having the components described below in TABLES IV and V, using a bar coater to provide a dry coating weight of radiation-sensitive imagable layer of 0.9 g/m$^2$ after drying at 50° C. for 60 seconds.

TABLE IV

Components of Radiation-Sensitive Imageable Layer Formulation

| Component | Amount (grams) |
|---|---|
| Polymer dispersion | 0.747 |
| Hydroxypropyl methyl cellulose | 0.400 |
| Monomer 1 | 0.333 |
| Monomer 2 | 0.167 |
| IR dye 1 | 0.020 |
| Leuco Dye 1 | 0.023 |
| Surfactant 1 | 0.045 |
| Iodonium salt | 0.05 |
| 1-Propanol | 3.27 |
| 2-Butanone | 1.60 |
| 1-Methoxy-2-propanol | 2.82 |
| δ-Butyrolactone | 0.10 |
| Water | 0.43 |

TABLE V

Description of Certain Radiation-sensitive Imageable Layer Components

| | |
|---|---|
| Polymer dispersion | The polymer dispersion prepared according to Example 10 of EP 1,765,593A1, used as 23.5 weight % polymer in n-propanol/water at 80:20 weight ratio |

TABLE V-continued

| Description of Certain Radiation-sensitive Imageable Layer Components | |
|---|---|
| Hydroxy propyl methyl cellulose | 5 weight % hydroxypropyl methyl cellulose polymer in water; the polymer is 30% methoxylated, 10% hydroxyl propoxylated and has a viscosity of 5 mPa sec in a 2% aqueous solution at 20° C. |
| Monomer 1 | Urethane acrylate prepared by reacting DESMODUR ® N100 (from Bayer Corp., Milford, CT) with hydroxyethyl acrylate and pentaerythritol triacrylate at approximately 1:1.5:1.5 molar ratio (40 weight % in 2-butanone). |
| Monomer 2 | Ethoxylated (10 EO) Bisphenol A acrylate, 40 weight % in 2-butanone |
| IR dye 1 | 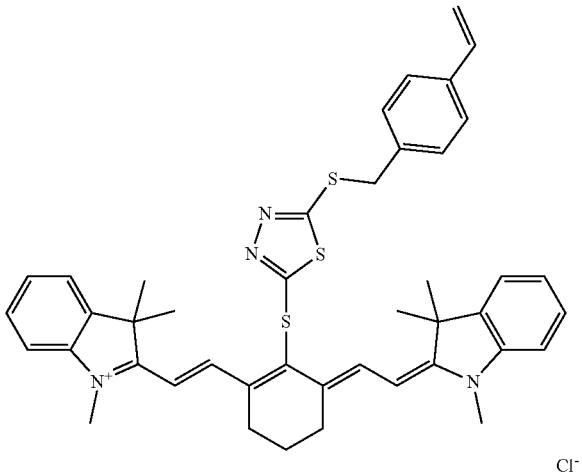 |
| Leuco dye 1 | 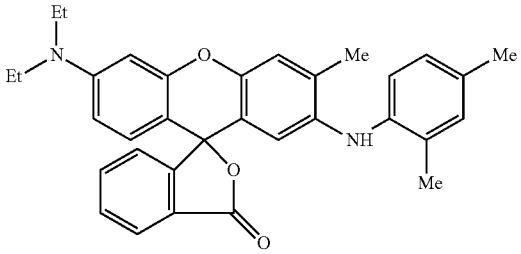 |
| Iodonium salt | A tetraphenyl borate salt having the following cation: 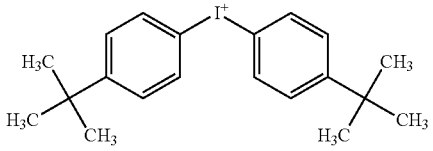 |
| Surfactant 1 | BYK ® 302 from Byk Chemie, used as a 25 weight % solution in 1-methoxy-2-propanol |

Each of the Invention lithographic printing plate precursors was evaluated with respect to press life, on-press developability, and scratch resistance using the test methods described below and the results are shown in the following TABLE VI.

Press Life Evaluation:

To evaluate press life, each lithographic printing plate precursor was imagewise exposed using a Trendsetter 800 III Quantum (available from Eastman Kodak Company) at 150 mJ/cm$^2$ and then mounted on a Favorit 04 printing press (available from Man Roland) without any development process in between. In other words, each was developed on-press using the printing press that was operated with Varn Supreme 6038+Par fountain solution and Gans Cyan printing ink. The press life printing test was performed up to 100,000 impressions with each resulting lithographic printing plate. With ongoing printing, the lithographic printing plates were gradually abraded.

The "press life" for each lithographic printing plate is defined as the number of printed paper sheets before the tonal value of the printed paper sheets in a 50% FM20 screen had been reduced to 70% or less of the tonal value obtained on the 1000$^{th}$ sheet. For the measurement of tonal values, a Techkon Spectro Dens spectral densitometer was used, and the results were scored as follows:

A: equal to or more than 80,000 sheets

B: equal to or more than 60,000 sheets, but less than 80,000 sheets

C: equal to or more than 40,000 sheets, but less than 60,000 sheets

D: equal to or more than 12,000 sheets, but less than 40,000 sheets

E: less than 12,000 sheets

On-Press Developability:

On-press developability was evaluated under the same exposure and printing press conditions as for the press life test, but only the first 1000 printed sheets were evaluated for each lithographic printing plate, and each precursor was exposed in segments at different energies of between 50 $mJ/cm^2$ and 300 $mJ/cm^2$ instead of 150 $mJ/cm^2$ on the full printing plate. On the first 10 revolutions, the printing press was operated only with fountain solution, and afterwards lithographic ink was supplied to the lithographic printing plates and printing paper was fed to the machine. During the on-press development process, the non-exposed regions of the radiation-sensitive imagable layer initially transferred lithographic ink to printed sheets. On-press development was finished when the lithographic ink density on the printed sheets in the non-exposed regions (corresponding to the non-image regions) became invisible to the naked eye and was scored as follows:

A: development finished with 5 or fewer sheets of paper

B: development finished with more than 5 sheets, but 10 or fewer sheets of paper C: development finished with more than 10 sheets, but 15 or fewer sheets of paper D: development finished with more than 15 sheets, but 50 or fewer sheets of paper E: development finished with more than 50 sheets of paper Scratch Resistance:

To assess scratch resistance, a heavy duty scouring pad (marketed for household cleaning) was placed under a weight with a circular shape having a diameter of 50 mm, and pulled at a constant speed of 0.2 m/sec across the radiation-sensitive imagable layer side of each lithographic printing plate precursor cut into a rectangular shape of 600 mm×200 mm. The procedure was repeated on different regions of each lithographic printing plate precursor using weights that varied as 100 g, 300 g, 600 g, 900 g, and 1200 g. The precursors afterwards were dipped into a 100 ml $CuSO_4$ solution for 60 seconds at 20° C., in which the $CuSO_4$ reacted with the bare aluminum metal exposed in the scratches, rendering them a brownish color. The $CuSO_4$ solution was obtained by dissolving 151 g of $CuSO_4*5H_2O$ in 800 ml of 1.0 molar HCl and then diluting the resulting solution with equal amount of deionized water. Each lithographic printing plate precursor treated in this manner was visually assessed and the total number of individual brownish scratches was determined, where 10 or less scratches in one run with one of the weights were recorded as the actual count and more than 10 scratches in one run with one of the weights were counted as "20". The following scoring method was used in the evaluation:

A: less than 30 scratches

B: equal to or more than 30 scratches but less than 40 scratches

C: equal to or more than 40 scratches but less than 50 scratches

D: equal to or more than 50 scratches but less than 70 scratches

E: equal to or more than 70 scratches

Edge Burn Tendency:

The edge burn tendency was tested optically, since differences in oxide layer thickness can easily be evaluated by eye due to color changes of the inventive substrate surface. The evaluation was scored as follows:

A: plate looks absolutely smooth and regular, no hint to edge burn

C: very slight irregularities on the plate (nearly invisible)

E: severe irregularities

TABLE VI

Properties of Invention Precursors

| Invention Example | Press Life | On-press Developability | Scratch Resistance | Edge Burn Tendency |
|---|---|---|---|---|
| 1 | B | A | A | A |
| 2 | B | A | A | A |
| 3 | A | A | A | A |
| 4 | A | A | A | A |
| 5 | A | A | A | A |
| 6 | C | A | A | A |
| 7 | B | A | A | A |
| 8 | A | A | A | A |
| 9 | A | A | A | A |
| 10 | A | A | A | A |
| 11 | C | C | A | C |
| 12 | B | C | A | C |
| 13 | B | C | A | C |
| 14 | A | C | A | C |
| 15 | B | A | C | A |
| 16 | C | A | C | A |
| 17 | B | C | C | C |
| 18 | B | A | A | A |
| 19 | A | A | A | A |
| 20 | B | A | A | A |
| 21 | C | A | A | A |
| 22 | B | C | A | C |
| 23 | B | A | A | A |
| 24 | C | A | A | A |
| 25 | B | C | A | C |
| 28 | A | A | A | A |
| 29 | A | A | A | A |
| 30 | A | A | A | A |
| 31 | A | A | A | A |

The results shown above in TABLE VI show that the lithographic printing plate precursors of Invention Examples 1-31 exhibited excellent press life after imaging, on-press developability, and scratch resistance while showing no tendency to edge burn. Each inner aluminum oxide layer, having an average inner micropore diameter ($D_i$) of less than 15 nm and an average dry thickness ($T_i$) of at least 650 nm is believed to be responsible for the desired scratch resistance. It can be further seen that in general, the thicker of the inner aluminum oxide layer, the better the scratch resistance observed.

The excellent press life and on-press developability properties of the lithographic printing plate precursors of Invention Examples 1-31 are believed to be provided at least in part from the porous structure of the outer aluminum oxide layer that had an average outer micropore diameter ($D_o$) of at least 15 nm and up to and including 30 nm, a porosity ($P_o$) of at least 30% and up to and including 80%, and average dry thickness ($T_o$) of at least 150 nm.

Comparative Examples 1 to 50

Comparative lithographic printing plate substrates and precursors labeled as Comparative Examples 1-51 were prepared in the same manner as described above for Invention Examples 1-31 except that the grained and etched substrates were anodized using the parameters described below in TABLE VII. For Comparative Examples 30-35, no second anodizing process was carried out. For Comparative Examples 41-50, a micropore-widening step was performed after the first anodizing process and before a second anodizing process by etching the outer aluminum oxide layer with an alkaline solution.

In TABLE VII, the parameters are identified as follows:

A1=Electrolyte
A2=Electrolyte concentration (g/liter)
A3=Temperature (° C.)
A4=Current density (A/dm$^2$)
A5=Time (seconds)
A6=Charge density (C/dm$^2$)
B1=Electrolyte
B2=Electrolyte concentration (g/liter)
B3=Temperature (° C.)
B4=Time (seconds)
C1=Electrolyte
C2=Electrolyte concentration (g/liter)
C3=Temperature (° C.)
C4=Current density (A/dm$^2$)
C5=Time (seconds)
C6=Charge density (C/dm$^2$)

TABLE VII

Process Parameters for Substrate Preparation

| Comparative | First Anodizing Process | | | | | | Micropore Widening | | | | Second Anodizing Process | | | | | |
|---|---|---|---|---|---|---|---|---|---|---|---|---|---|---|---|---|
| Example | A1 | A2 | A3 | A4 | A5 | A6 | B1 | B2 | B3 | B4 | C1 | C2 | C3 | C4 | C5 | C6 |
| 1 | $H_3PO_4$ | 300 | 60 | 8.5 | 1.6 | 13.8 | | | | | $H_2SO_4$ | 280 | 23 | 10.0 | 18.0 | 180.0 |
| 2 | $H_3PO_4$ | 250 | 60 | 6.6 | 4.2 | 27.6 | | | | | $H_2SO_4$ | 280 | 23 | 10.0 | 18.0 | 180.0 |
| 3 | $H_3PO_4$ | 200 | 60 | 5.5 | 8.0 | 44.2 | | | | | $H_2SO_4$ | 280 | 23 | 10.0 | 18.0 | 180.0 |
| 4 | $H_3PO_4$ | 175 | 50 | 1.8 | 7.7 | 13.8 | | | | | $H_2SO_4$ | 280 | 23 | 10.0 | 18.0 | 180.0 |
| 5 | $H_3PO_4$ | 175 | 55 | 3.8 | 7.3 | 27.6 | | | | | $H_2SO_4$ | 280 | 23 | 10.0 | 18.0 | 180.0 |
| 6 | $H_3PO_4$ | 100 | 50 | 3.3 | 4.2 | 13.8 | | | | | $H_2SO_4$ | 280 | 23 | 10.0 | 18.0 | 180.0 |
| 7 | $H_3PO_4$ | 150 | 50 | 5.2 | 5.4 | 27.6 | | | | | $H_2SO_4$ | 280 | 23 | 10.0 | 18.0 | 180.0 |
| 8 | $H_3PO_4$ | 200 | 50 | 7.1 | 6.3 | 44.2 | | | | | $H_2SO_4$ | 280 | 23 | 10.0 | 18.0 | 180.0 |
| 9 | $H_3PO_4$ | 50 | 60 | 18.6 | 0.7 | 13.8 | | | | | $H_2SO_4$ | 280 | 23 | 10.0 | 18.0 | 180.0 |
| 10 | $H_3PO_4$ | 100 | 60 | 20.5 | 1.3 | 27.6 | | | | | $H_2SO_4$ | 280 | 23 | 10.0 | 18.0 | 180.0 |
| 11 | $H_3PO_4$ | 150 | 60 | 22.4 | 2.0 | 44.2 | | | | | $H_2SO_4$ | 280 | 23 | 10.0 | 18.0 | 180.0 |
| 12 | $H_3PO_4$ | 200 | 60 | 24.3 | 2.9 | 70.7 | | | | | $H_2SO_4$ | 280 | 23 | 10.0 | 18.0 | 180.0 |
| 13 | $H_3PO_4$ | 250 | 60 | 26.2 | 4.7 | 123.7 | | | | | $H_2SO_4$ | 280 | 23 | 10.0 | 18.0 | 180.0 |
| 14 | $H_3PO_4$ | 300 | 60 | 28.1 | 6.3 | 176.7 | | | | | $H_2SO_4$ | 280 | 23 | 10.0 | 18.0 | 180.0 |
| 15 | $H_3PO_4$ | 350 | 60 | 30.0 | 9.6 | 287.6 | | | | | $H_2SO_4$ | 280 | 23 | 10.0 | 18.0 | 180.0 |
| 16 | $H_3PO_4$ | 150 | 60 | 22.4 | 18.8 | 419.3 | | | | | $H_2SO_4$ | 280 | 23 | 10.0 | 18.0 | 180.0 |
| 17 | $H_3PO_4$ | 150 | 55 | 1.8 | 53.6 | 123.6 | | | | | $H_2SO_4$ | 280 | 23 | 10.0 | 6.8 | 67.5 |
| 18 | $H_3PO_4$ | 150 | 55 | 2.9 | 12.8 | 44.0 | | | | | $H_2SO_4$ | 280 | 23 | 10.0 | 6.8 | 67.5 |
| 19 | $H_3PO_4$ | 150 | 55 | 7.1 | 23.1 | 177.7 | | | | | $H_2SO_4$ | 280 | 23 | 10.0 | 6.8 | 67.5 |
| 20 | $H_3PO_4$ | 150 | 55 | 20.3 | 3.5 | 67.1 | | | | | $H_2SO_4$ | 280 | 23 | 10.0 | 6.8 | 67.5 |
| 21 | $H_3PO_4$ | 250 | 55 | 5.6 | 53.8 | 123.7 | | | | | $H_2SO_4$ | 280 | 23 | 10.0 | 11.3 | 112.5 |
| 22 | $H_3PO_4$ | 250 | 55 | 6.7 | 13.0 | 44.2 | | | | | $H_2SO_4$ | 280 | 23 | 10.0 | 11.3 | 112.5 |
| 23 | $H_3PO_4$ | 250 | 55 | 10.9 | 23.1 | 176.7 | | | | | $H_2SO_4$ | 280 | 23 | 10.0 | 11.3 | 112.5 |
| 24 | $H_3PO_4$ | 250 | 55 | 24.1 | 3.4 | 70.7 | | | | | $H_2SO_4$ | 280 | 23 | 10.0 | 11.3 | 112.5 |
| 25 | $H_3PO_4$ | 350 | 55 | 27.9 | 3.5 | 66.9 | | | | | $H_2SO_4$ | 280 | 23 | 10.0 | 15.0 | 150.0 |
| 26 | $H_3PO_4$ | 250 | 55 | 10.9 | 5.8 | 44.2 | | | | | $H_2SO_4$ | 280 | 23 | 10.0 | 33.8 | 337.5 |
| 27 | $H_3PO_4$ | 250 | 55 | 24.1 | 5.9 | 123.7 | | | | | $H_2SO_4$ | 280 | 23 | 10.0 | 33.8 | 337.5 |
| 28 | $H_3PO_4$ | 150 | 55 | 20.3 | 3.5 | 73.4 | | | | | $H_2SO_4$ | 280 | 23 | 10.0 | 45.0 | 450.0 |
| 29 | $H_3PO_4$ | 350 | 55 | 27.9 | 3.4 | 71.9 | | | | | $H_2SO_4$ | 280 | 23 | 10.0 | 67.5 | 675.0 |
| 30 | $H_3PO_4$ | 175 | 55 | 3.5 | 19.2 | 67.1 | | | | | | | | | | 0.0 |
| 31 | $H_3PO_4$ | 175 | 55 | 3.5 | 41.7 | 145.9 | | | | | | | | | | 0.0 |
| 32 | $H_3PO_4$ | 175 | 55 | 3.5 | 62.7 | 219.4 | | | | | | | | | | 0.0 |
| 33 | $H_3PO_4$ | 175 | 55 | 3.5 | 80.4 | 281.3 | | | | | | | | | | 0.0 |
| 34 | $H_3PO_4$ | 175 | 55 | 3.5 | 96.5 | 337.8 | | | | | | | | | | 0.0 |
| 35 | $H_3PO_4$ | 175 | 55 | 3.5 | 188.1 | 658.3 | | | | | | | | | | 0.0 |
| 36 | $H_2SO_4$ | 280 | 23 | 10.0 | 11.3 | 112.5 | | | | | $H_2SO_4$ | 280 | 23 | 10.0 | 18.0 | 180.0 |
| 37 | $H_2SO_4$ | 280 | 23 | 16.0 | 8.4 | 135.0 | | | | | $H_2SO_4$ | 280 | 23 | 10.0 | 18.0 | 180.0 |
| 38 | $H_2SO_4$ | 280 | 23 | 24.0 | 6.7 | 160.0 | | | | | $H_2SO_4$ | 280 | 23 | 10.0 | 18.0 | 180.0 |
| 39 | $H_2SO_4$ | 280 | 23 | 30.0 | 5.3 | 160.0 | | | | | $H_2SO_4$ | 280 | 23 | 10.0 | 18.0 | 180.0 |
| 40 | $H_2SO_4$ | 280 | 23 | 45.0 | 3.6 | 160.0 | | | | | $H_2SO_4$ | 280 | 23 | 10.0 | 18.0 | 180.0 |
| 41 | $H_2SO_4$ | 280 | 23 | 10.0 | 1.4 | 13.5 | NaOH | 5 | 35 | 1 | $H_2SO_4$ | 280 | 23 | 10.0 | 18.0 | 180.0 |
| 42 | $H_2SO_4$ | 280 | 23 | 10.0 | 1.4 | 13.5 | NaOH | 5 | 35 | 4 | $H_2SO_4$ | 280 | 23 | 10.0 | 18.0 | 180.0 |
| 43 | $H_2SO_4$ | 280 | 23 | 10.0 | 1.4 | 13.5 | NaOH | 5 | 35 | 6 | $H_2SO_4$ | 280 | 23 | 10.0 | 18.0 | 180.0 |
| 44 | $H_2SO_4$ | 280 | 23 | 10.0 | 1.4 | 13.5 | NaOH | 5 | 35 | 12 | $H_2SO_4$ | 280 | 23 | 10.0 | 18.0 | 180.0 |
| 45 | $H_2SO_4$ | 280 | 23 | 10.0 | 1.4 | 13.5 | NaOH | 5 | 35 | 20 | $H_2SO_4$ | 280 | 23 | 10.0 | 18.0 | 180.0 |
| 46 | $H_2SO_4$ | 280 | 23 | 10.0 | 2.5 | 25.0 | NaOH | 5 | 35 | 6 | $H_2SO_4$ | 280 | 23 | 10.0 | 18.0 | 180.0 |
| 47 | $H_2SO_4$ | 280 | 23 | 10.0 | 7.6 | 76.0 | NaOH | 5 | 35 | 6 | $H_2SO_4$ | 280 | 23 | 10.0 | 18.0 | 180.0 |
| 48 | $H_2SO_4$ | 170 | 43 | 30.0 | 1.0 | 30.0 | NaOH | 5 | 35 | 6 | $H_2SO_4$ | 170 | 43 | 15.0 | 14.7 | 220.0 |
| 49 | $H_2SO_4$ | 170 | 43 | 30.0 | 1.0 | 30.0 | NaOH | 5 | 35 | 4 | $H_2SO_4$ | 170 | 40 | 20.0 | 12.5 | 250.0 |
| 50 | $H_2SO_4$ | 170 | 43 | 50.0 | 1.0 | 50.0 | NaOH | 5 | 35 | 16 | $H_2SO_4$ | 170 | 40 | 20.0 | 12.5 | 250.0 |

The lithographic printing plate substrates prepared for Comparative Examples 1-50 were evaluated using the same techniques as applied above for evaluating the inventive substrates of Invention Examples 1-31 and the determined structural features are shown in the following TABLE VIII.

Comparative Examples 1-50 lithographic printing plate precursors were prepared using the corresponding substrates described above by applying the hydrophilic coating formulation and negative-working radiation-sensitive imagable layer formulation described above for Invention Examples

TABLE VIII

Structural Features of Inner and Outer Aluminum Oxide Layers

| | Outer Aluminum Oxide Layer | | | | Inner Aluminum Oxide Layer | |
|---|---|---|---|---|---|---|
| Comparative Example | Average Dry Thickness ($T_o$) [nm] | Average Micropore Diameter ($D_o$) [nm] | Micropore Density ($P_o$) [1/μm$^2$] | Porosity [%] ($P_o$) | Average Dry Thickness ($T_i$) [nm] | Average Micropore Diameter ($D_i$) [nm] |
| 1 | 43 | 19 | 2703 | 76 | 785 | <10 |
| 2 | 77 | 19 | 2854 | 81 | 774 | <10 |
| 3 | 128 | 17 | 2736 | 64 | 821 | <10 |
| 4 | 39 | 20 | 1312 | 40 | 799 | <10 |
| 5 | 78 | 22 | 1343 | 52 | 804 | <10 |
| 6 | 53 | 29 | 582 | 39 | 816 | <10 |
| 7 | 94 | 29 | 592 | 39 | 787 | <10 |
| 8 | 140 | 31 | 626 | 47 | 773 | <10 |
| 9 | 41 | 36 | 380 | 39 | 788 | <10 |
| 10 | 92 | 36 | 372 | 38 | 811 | <10 |
| 11 | 185 | 38 | 376 | 42 | 830 | <10 |
| 12 | 215 | 34 | 367 | 33 | 797 | <10 |
| 13 | 312 | 39 | 370 | 44 | 807 | <10 |
| 14 | 348 | 36 | 392 | 40 | 820 | <10 |
| 15 | 489 | 37 | 383 | 40 | 808 | <10 |
| 16 | 587 | 39 | 381 | 46 | 775 | <10 |
| 17 | 311 | 17 | 2703 | 64 | 287 | <10 |
| 18 | 146 | 22 | 1308 | 51 | 299 | <10 |
| 19 | 479 | 27 | 628 | 36 | 288 | <10 |
| 20 | 213 | 34 | 386 | 35 | 295 | <10 |
| 21 | 311 | 16 | 2610 | 55 | 517 | <10 |
| 22 | 142 | 20 | 1222 | 37 | 508 | <10 |
| 23 | 503 | 27 | 580 | 33 | 528 | <10 |
| 24 | 207 | 35 | 385 | 36 | 494 | <10 |
| 25 | 224 | 33 | 375 | 32 | 623 | <10 |
| 26 | 163 | 32 | 619 | 50 | 1508 | <10 |
| 27 | 305 | 38 | 377 | 44 | 1519 | <10 |
| 28 | 183 | 36 | 395 | 41 | 2023 | <10 |
| 29 | 191 | 36 | 376 | 39 | 3028 | <10 |
| 30 | 190 | 21 | 1311 | 47 | 0 | NA-1 |
| 31 | 413 | 22 | 1316 | 50 | 0 | NA-1 |
| 32 | 621 | 20 | 1234 | 38 | 0 | NA-1 |
| 33 | 796 | 19 | 1227 | 37 | 0 | NA-1 |
| 34 | 956 | 22 | 1222 | 47 | 0 | NA-1 |
| 35 | 1863 | 23 | 1338 | 55 | 0 | NA-1 |
| 36 | 512 | <10 | NA-2 | NA-2 | 804 | <10 |
| 37 | 615 | <10 | NA-2 | NA-2 | 790 | <10 |
| 38 | 681 | <10 | NA-2 | NA-2 | 797 | <10 |
| 39 | 703 | <10 | NA-2 | NA-2 | 778 | <10 |
| 40 | 719 | <10 | NA-2 | NA-2 | 773 | <10 |
| 41 | 60 | <10 | 2430 | <21 | 809 | <10 |
| 42 | 62 | <10 | 2613 | <21 | 788 | <10 |
| 43 | 62 | 10 | 2575 | 20 | 796 | <10 |
| 44 | 61 | 13 | 2501 | 33 | 793 | <10 |
| 45 | 62 | NA-3 | NA-3 | 90-100 | 817 | <10 |
| 46 | 114 | 13 | 2567 | 34 | 801 | <10 |
| 47 | 336 | 13 | 2468 | 33 | 792 | <10 |
| 48 | 47 | 25 | 553 | 27 | 926 | <10 |
| 49 | 45 | 21 | 623 | 22 | 985 | <10 |
| 50 | 79 | 48 | 472 | 85 | 1012 | <10 |

NA-1: not applicable due to absence of the inner aluminum oxide layer;

NA-2: the micropore diameter in the outer aluminum oxide layer is too small to measure micropore density and to calculate the porosity;

NA-3: the outer aluminum oxide layer was severely damaged by the micropore-widening treatment such that it was not possible to measure the micropore diameter and micropore density.

1-31. The resulting lithographic printing plate precursors were imagewise exposed (when appropriate) and evaluated using the same procedures and evaluation tests as described above for Invention Examples 1-31. The results of these evaluations are shown in the following TABLE IX.

TABLE IX

Properties of Comparative Precursors

| Comparative Example | Press Life | On-press Developability | Scratch Resistance | Edge Burn Tendency |
|---|---|---|---|---|
| 1 | E | A | A | A |
| 2 | D | A | A | A |
| 3 | C | A | A | A |
| 4 | E | A | A | A |
| 5 | D | A | A | A |
| 6 | E | C | A | C |
| 7 | E | C | A | C |
| 8 | C | D | A | C |
| 9 | E | D | A | E |
| 10 | E | D | A | E |
| 11 | D | D | A | E |
| 12 | D | D | A | E |
| 13 | D | D | A | E |
| 14 | C | D | A | E |
| 15 | B | D | A | E |
| 16 | A | D | A | E |
| 17 | B | A | D | A |
| 18 | B | A | D | A |
| 19 | B | C | D | C |
| 20 | D | D | D | E |
| 21 | B | A | D | A |
| 22 | C | A | D | A |
| 23 | B | C | D | C |
| 24 | D | D | D | E |
| 25 | D | D | C | E |
| 26 | D | C | A | C |
| 27 | D | D | A | E |
| 28 | D | D | A | E |
| 29 | D | D | A | E |
| 30 | B | A | E | A |
| 31 | A | A | E | A |
| 32 | A | A | E | A |
| 33 | A | A | D | A |
| 34 | A | A | D | A |
| 35 | A | A | D | A |
| 36 | E | E | A | A |
| 37 | E | E | A | A |
| 38 | E | E | A | A |
| 39 | E | E | A | C |
| 40 | E | E | A | D |
| 41 | E | E | A | A |
| 42 | E | E | A | A |
| 43 | E | E | A | A |
| 44 | E | E | A | A |
| 45 | E | E | A | A |
| 46 | E | E | A | A |
| 47 | E | E | A | A |
| 48 | E | E | A | A |
| 49 | E | E | A | A |
| 50 | E | E | A | A |

The results shown in TABLE IX for Comparative Examples 1-50 that are outside of the present invention reveal one or more disadvantages for each Comparative precursor over the results obtained from the Invention Examples 1-31 comprising inventive substrates. The precursors identified as Comparative Examples 17-25 showed unsatisfactory scratch resistance. These precursors were derived using substrates having an inner aluminum oxide layer with very small average inner micropore diameter ($D_i$) (<10 nm) and an average dry thickness ($T_i$) of less than 650 nm. In Comparative Examples 30-35, the scratch resistance was inadequate because the inner aluminum oxide layer was not formed. Apparently, the omission of the inner aluminum oxide layer cannot be compensated for by increasing the average dry thickness ($T_o$) of the outer aluminum oxide layer. The average outer micropore diameter ($D_o$) of the outer aluminum oxide layer is important for the on-press developability of the imagewise exposed precursor. If the average outer micropore diameter ($D_o$) is too small, as in the substrates of Comparative Examples 36-40, or too large as in the substrates used in Comparative Examples 8-16, 20, 24-29, and 50, on-press-developability of the imagewise exposed precursor is inadequate. Moreover, the precursor press life is low when the average dry layer thickness ($T_o$) of the outer aluminum oxide layer is too small as in the case of the substrates used in Comparative Examples 1-7, 9, 10, 41-46, and 48-50.

In Comparative Examples 41-50, the micropores of the outer aluminum oxide layer were enlarged in a micropore widening step using a sodium hydroxide solution and procedures like those described in U.S. Pat. No. 8,783,179B2 (Kurokawa et al.), and EP Patent Publications 2,878,452A1 (Tagawa et al.) and 2,808,173A1 (Namba et al.), and an inner aluminum oxide layer was then formed underneath the outer aluminum oxide layer. For Comparative Example 45, a nearly complete dissolution of the outer aluminum oxide layer occurred during the micropore widening step. In general, the Comparative Examples in which a micropore widening process was used between the separate anodizing processes did not show adequate press life or on-press-developability. These Comparative Examples are outside the scope of the present invention due to the undesirable average outer micropore diameter, dry outer layer thickness, or outer aluminum oxide layer porosity.

The invention has been described in detail with particular reference to certain preferred embodiments thereof, but it will be understood that variations and modifications can be affected within the spirit and scope of the invention.

The invention claimed is:

1. A method for providing a lithographic printing plate, comprising the steps in the order of:

A) providing an on-press developable, negative-working lithographic printing plate precursor comprising a substrate and a negative-working, infrared radiation-sensitive imagable layer;

B) imagewise exposing the on-press developable, negative-working lithographic printing plate precursor to infrared radiation to form an imaged lithographic printing plate precursor having infrared radiation exposed and infrared radiation non-exposed regions in an imaged surface of the negative-working, infrared radiation-sensitive imagable layer;

C) without any prior wet processing, mounting the imaged lithographic printing plate precursor onto a lithographic printing press comprising:

a plate cylinder for holding the imaged lithographic printing plate precursor, an inking system capable of supplying a lithographic printing ink to the imaged surface, a dampening system capable of supplying a fountain solution to the imaged surface, a blanket cylinder capable of transferring the lithographic printing ink from the imaged lithographic printing plate precursor, an impression cylinder capable of pressing one or more printing papers onto the blanket cylinder, and thus transferring the lithographic printing ink from the blanket cylinder onto the one or more printing papers, and a printing paper feeding system for supplying the one or more printing papers to the impression cylinder;

D) engaging the dampening system;

E) causing not more than 20 revolutions of the plate cylinder;

F) engaging the inking system;

G) causing not more than 20 revolutions of the plate cylinder;

H) feeding printing papers for at least 1 and up to and including 30 revolutions of the plate cylinder until the imaged lithographic printing plate precursor is fully developed to become a functioning lithographic printing plate having ink-accepting image regions substantially corresponding to the infrared radiation exposed regions and non-ink-accepting hydrophilic non-image regions substantially corresponding to the infrared radiation non-exposed regions; and I) operating the lithographic printing press beyond the revolutions of the plate cylinder required for completing step E) to produce a desired number of lithographically printed papers, wherein the lithographic printing plate precursor comprises:

(i) a substrate having a planar surface, and (ii) a negative-working, infrared radiation-sensitive imagable layer disposed over the planar surface of the substrate, wherein the (i) substrate comprises:

an aluminum-containing plate having a grained and etched planar surface;

an inner aluminum oxide layer disposed on the grained and etched planar surface, the inner aluminum oxide layer having an average dry thickness ($T_i$) of at least 650 nm and up to and including 3,000 nm; and comprising a multiplicity of inner micropores having an average inner micropore diameter ($D_i$) of less than 15 nm;

an outer aluminum oxide layer disposed on the inner aluminum oxide layer, the outer aluminum oxide layer: comprising a multiplicity of outer micropores having an average outer micropore diameter ($D_o$) of at least 15 nm and up to and including 30 nm; having an average dry thickness ($T_o$) of at least 130 nm and up to and including 650 nm; and having a micropore density ($C_o$) of at least 500 micropores/$\mu m^2$ and up to and including 3,000 micropores/$\mu m^2$, wherein the ratio of the average outer micropore diameter ($D_o$) to the average inner micropore diameter ($D_i$) is greater than 1.1:1, and the average outer micropore diameter ($D_o$) in nanometers and the micropore density ($C_o$) in micropores/$\mu m^2$, are further constrained by the porosity ($P_o$) of the outer aluminum oxide layer according to the following equation:

$$0.3 \leq P_o \leq 0.8$$

wherein $P_o$ is $3.14(C_o)(D_o^2)/4{,}000{,}000$; and optionally, a hydrophilic coating comprising one or more hydrophilic polymers, which hydrophilic coating is disposed on the outer aluminum oxide layer at a dry coverage of at least 0.0002 g/$m^2$ and up to and including 0.1 g/$m^2$.

2. The method of claim 1, wherein the imagewise exposing is carried out using infrared radiation laser.

3. The method of claim 1, wherein the outer aluminum oxide layer has an average dry thickness ($T_o$) of at least 150 nm and up to and including 400 nm.

4. The method of claim 1, wherein the inner aluminum oxide layer has an average dry thickness ($T_i$) of at least 700 nm and up to and including 1500 nm.

5. The method of claim 1, wherein porosity ($P_o$) is defined by the following equation:

$$0.3 \leq P_o \leq 0.6.$$

6. The method of claim 1, wherein the ratio of the average outer micropore diameter ($D_o$) to the average inner micropore diameter ($D_i$) is at least 1.5:1.

7. The method of claim 1, wherein the lithographic printing plate precursor further comprises the hydrophilic coating that comprises one or more water-soluble polymers, at least one of which water-soluble polymers comprises recurring units derived from either acrylic acid or methacrylic acid, or both acrylic acid and methacrylic acid.

8. The method of claim 1, wherein the (ii) negative-working, infrared radiation-sensitive imagable layer comprises one or more infrared radiation absorbers.

9. The method of claim 1, wherein the (ii) negative-working, infrared radiation-sensitive imagable layer comprises:

(a) one or more free radically polymerizable components;

(b) an initiator composition that provides free radicals upon exposure of the negative-working, infrared radiation-sensitive imagable layer to radiation;

(c) one or more infrared radiation absorbers; and, optionally, (d) a polymeric binder that is different from all of (a), (b), and (c).

10. The method of claim 9, wherein the negative-working, infrared radiation-sensitive layer further comprises the (d) polymeric binder that is in particulate form.

11. The method of claim 1, wherein the lithographic printing plate precursor further comprises a (iii) hydrophilic overcoat disposed over the negative-working, infrared radiation-sensitive imagable layer.

12. The method of claim 1, wherein:

the grained and etched planar surface of the aluminum-containing plate has been electrochemically grained and etched;

the inner aluminum oxide layer has an average dry thickness ($T_i$) of at least 700 nm and up to and including 1,500 nm;

the outer aluminum oxide layer has an average dry thickness ($T_o$) of at least 150 nm and up to and including 400 nm; and the ratio of the average outer micropore diameter ($D_o$) to the average inner micropore diameter ($D_i$) is at least 1.5:1 and porosity ($P_o$) is defined by the following equation:

$$0.3 \leq P_o \leq 0.6;$$

and the hydrophilic coating is present and comprises a polymer comprising recurring units derived from acrylic acid, which hydrophilic coating is present at a dry coverage of at least 0.005 g/$m^2$ and up to and including 0.08 g/$m^2$.

* * * * *